US005368994A

United States Patent [19]

Fujiwara et al.

[11] Patent Number: 5,368,994

[45] Date of Patent: Nov. 29, 1994

[54] SILVER HALIDE PHOTOGRAPHIC MATERIAL

[75] Inventors: Itsuo Fujiwara; Tadashi Ito; Naoki Arai, all of Kanagawa, Japan

[73] Assignee: Fuji Photo Film Co., Ltd., Kanagawa, Japan

[21] Appl. No.: 55,874

[22] Filed: May 4, 1993

[30] Foreign Application Priority Data

May 6, 1992 [JP] Japan ..... 4-139607

[51] Int. Cl.[5] ..... G03C 1/08

[52] U.S. Cl. ..... 430/508; 430/506; 430/509; 430/604; 430/605; 430/944; 430/945

[58] Field of Search ..... 430/503, 506, 604, 605, 430/508, 509, 945, 944

[56] References Cited

U.S. PATENT DOCUMENTS

| | | | |
|---|---|---|---|
| 4,469,783 | 9/1984 | Kuwabara et al. | 430/605 |
| 4,477,561 | 10/1984 | Menjo et al. | 430/605 |
| 4,619,892 | 10/1986 | Simpson et al. | 430/508 |
| 4,792,518 | 12/1988 | Kuwashima et al. | 430/506 |

FOREIGN PATENT DOCUMENTS

| | | |
|---|---|---|
| 61-47941 | 3/1986 | Japan . |
| 254533 | 11/1990 | Japan . |

*Primary Examiner*—Charles L. Bowers, Jr.
*Assistant Examiner*—Geraldine Letscher
*Attorney, Agent, or Firm*—Sughrue, Mion, Zinn, Macpeak & Seas

[57] ABSTRACT

A silver halide photographic material comprising a hydrophilic colloidal layer structure including at least two silver halide emulsion layers provided on at least one common side of a transparent support, wherein the average content of iridium compound per unit mol of silver in the silver halide emulsion layer on the side nearer to the support is greater than that of the silver halide emulsion layer located further from the support, and, characterized by at least one of (1) when exposed to laser light having a wavelength of 600 to 850 nm, the maximum value of $\gamma$ on the characteristic curve of optical density versus exposure (logarithm) is not more than 3.2; or (2) the average grain size of the grains in the silver halide emulsion layer located further from the support is greater than that of the grains in the silver halide emulsion layer located nearer to the support. Further, a process for the processing of a silver halide photographic material is provided, characterized in that the silver halide photographic material as defined above is used wherein the total coated amount of gelatin and silver on the side of the support having the silver halide layers are 3.5 g/m$^2$ or less and 2.7 g/m$^2$ or less, respectively, is conveyed at a line speed of 1,500 mm/min and all steps of development, fixing, rinse and drying are completed within 60 seconds in a roller type automatic processor.

11 Claims, No Drawings

SILVER HALIDE PHOTOGRAPHIC MATERIAL

FIELD OF THE INVENTION

The present invention relates to a silver halide photographic material. More particularly, the present invention relates to a photographic material which can be rapidly developed and fixed to give a low contrast image when processed by means of an automatic processor. Further, the present invention relates to a recording material for use in a laser imager system, such as a He-Ne laser or a semiconductor laser.

BACKGROUND OF THE INVENTION

In the contemporary medical diagnostic field, a laser imager which scans a photographic material with laser light for recording has been used as a system for recording an image output from a diagnostic apparatus such as X-ray CT and MRI (nuclear magnetic resonance apparatus). This laser imager system, desirably, would be capable of recording and developing an image in a shorter period of time to provide a rapid diagnosis.

As recording lasers used for such a laser imager known recording laser for this purpose have a wavelength of 600 to 700 nm, such as He-Ne laser, and another recording layer having a wavelength of 700 to 850 nm, such as semiconductor laser.

Various properties are required by photographic materials for use in the laser recording system. In particular, since exposure is effected in a period of time as short as $10^{-3}$ to $10^{-7}$ second in this system, a relatively soft contrast recording material has been required in order to provide a high sensitivity and a sufficient black density and reduce uneven exposure upon a rapid processing under these conditions.

Various methods for the purpose of providing a sufficient black density in a short time development process have been known. Examples of these known methods include a method which comprises adjusting a gelatin crosslinking agent (film hardener) so as to increase the swelling of an emulsion layer in the development process; a high temperature rapid processing method which substantially prevents a developer from hardening gelatin (as disclosed in JP-A-63-136043 (The term "JP-A" as used herein means an "unexamined published Japanese patent application")); and a method which comprises the addition of a polymer such as acrylamide and dextran compound (as disclosed in U.S. Pat. Nos. 3,271,158, 3,514,289, 3,063,838, 3,272,631). However, these methods are disadvantageous in that the photographic material is dried slowly or the resulting film strength is poor. Alternatively, method which comprises the enhancement of the development activity of the processing solution is also known. To this end, the content of a developing agent or auxiliary developing agent in the developer may be increased. Alternatively, the pH value of the developer may be increased. Further, the processing temperature may be raised. However, these approaches are all disdavantageous in that the preservability of the processing solution is impaired or fog can easily take place.

Moreover, a method which comprises the concentration of development center of halide grains to enhance the development activity has been known. For example, a method which comprises doping an iridium compound during the formation of grains (as disclosed in Japanese Patent Application No. 3-266934) may be used.

However, the use of an iridium compound produces adverse side effects such as sensitivity drop and contrast hardening. In particular, silver halide emulsions which can be rapidly developed tend to provide a high contrast. Therefore, if the recording material used exhibits too high a gradation, scan line due to laser exposure or unevenness can easily take place, making it difficult to put this approach into practical use.

Thus, it has recently been desired to provide a photographic material which exhibits a sensitivity enough for a laser imager, an excellent adaptability to be rapidly processed and an appropriate gradation.

On the other hand, a method which comprises finely dividing silver halide emulsion grains for the purpose of obtaining a high density with a small coated amount of silver and hence enabling a rapid processing has been well known by those skilled in the art. However, this method is disadvantageous in that, as the size of silver halide emulsion grains is reduced, the surface gloss of developed image portion grows, causing a room lamp to be reflected and hence making the recorded image difficultly observable. Thus, photographic materials satisfying all these requirements have never been realized heretofore.

SUMMARY OF THE INVENTION

It is therefore an object of the present invention to provide a silver halide photographic material for laser imager which exhibits an excellent capability and adaptability to be rapidly processed under a high intensity exposure condition as short as $10^{-3}$ to $10^{-7}$ second and provides a relatively soft contrast image, and an appropriate surface gloss and a process for the processing thereof.

The aforementioned object of the present invention will become more apparent from the following detailed description and examples.

The above object of the present invention is accomplished with a silver halide photographic material comprising a hydrophilic colloidal layer structure including at least two silver halide emulsion layers provided on at least one side of a transparent support, wherein the average amount of iridium compound per unit mol of silver in the lower silver halide emulsion layer located nearer to the support is greater than the iridium content of the upper silver halide emulsion layer located further from the support, and the maximum value of $\gamma$ on the characteristic curve of optical density versus exposure (logarithm) is not more than 3.2, preferably from 1.5 to 3.2, when the silver halide photographic material is exposed to laser light having a wavelength falling within the range of 600 to 850 nm for forming an image.

In a further embodiment of the present invetion, the object of the present invention is further accomplished with a silver halide photographic material comprising a hydrophilic colloidal layer structure including at least two silver halide emulsion layers provided on at least one side of a transparent support, wherein the average amount of iridium compound per unit mol of silver in the lower silver halide emulsion layer located nearer to the support is greater than the iridium content of the upper silver halide emulsion layer located further from the support and the average grain size of the grains in the upper silver halide emulsion layer is greater than average grain size of the grains in the lower silver halide emulsion layer.

DETAILED DESCRIPTION OF THE INVENTION

The present invention will be further described hereinafter.

The silver halide photographic material to be used in the present invention comprises a hydrophilic colloidal layer structure including at least two silver halide emulsion layers on one common side of a support. These silver halide emulsions may have the same or different light-sensitivities. However, when exposed to light of wavelength of 600 to 850 nm, the two silver halide emulsions are preferably 1.5 times or more, more preferably twice or more different from each other in terms of the reciprocal of the exposure at an optical density of fog +1.0. An intermediate layer may be provided between the two silver halide emulsion layers.

The basic effects of the present invention remain unaffected regardless of sequence of the high sensitivity emulsion layer and the low sensitivity emulsion layer as disposed nearer to or further from the support, respectively. Preferably, however, the high sensitivity emulsion layer is disposed further from the support while the low sensitivity is disposed relatively nearer to the support to accomplish the effects of the present invention even more effectively.

The measurement of the sensitivity of the silver halide emulsion layer is accomplished by generally well known methods by those skilled in the art. The sensitivity of silver halide emulsion is defined as the reciprocal of the exposure giving an optical density of a developed density at unexposed portion +1.0. The exposure wavelength can be arbitrarily selected between 600 nm and 850 nm.

The development of the silver halide photographic material was conducted with the following exemplary developer (I) and exemplary fixing solution (I) by means of a Type FPM5000 automatic processor available from Fuji Photo Film Co., Ltd. at a development temperature of 35° C. in a dry-to-dry time of 90 seconds.

The value of $\gamma$ is defined as the gradient of the tangent (optical density/logarithm of exposure) of the characteristic curve of optical density versus logarithm of exposure of the photographic material thus processed.

| Composition of Developer (I) | |
|---|---|
| Potassium hydroxide | 29 g |
| Sodium sulfite | 31 g |
| Potassium sulfite | 44 g |
| Diethylenetriaminepentaacetic acid | 1.7 g |
| Boric acid | 1 g |
| Hydroquinone | 30 g |
| Diethylene glycol | 29 g |
| 1-Phenyl-3-pyrazolidone | 1.5 g |
| Glutaraldehyde | 4.9 g |
| 5-Methylbenzotriazole | 60 mg |
| 5-Nitroindazole | 0.25 g |
| Potassium bromide | 4 g |
| Acetic acid | 8 g |
| Water to make | 1 l |
| pH | 10.20 |
| Composition of Fixing Solution (I) | |
| Ammonium thiosulfate | 140 g |
| Sodium sulfite | 15 g |
| Disodium ethylenediaminetetraacetate dihydrate | 20 mg |
| Sodium hydroxide | 7 g |
| Aluminum sulfate | 10 g |
| Boric acid | 10 g |
| Sulfuric acid | 3.9 g |

-continued

| | |
|---|---|
| Acetic acid | 15 g |
| Water to make | 1 l |
| pH | 4.30 |

In the silver halide photographic material to be used in the present invention, the total coated amount of gelatin on the silver halide emulsion layer side of the support is in the range of 4.0 g/m$^2$ or less, preferably 3.5 g/m$^2$ or less, with the lower limit preferably being 1.5 g/m$^2$, and the total coated amount of silver on the silver halide emulsion layer side of the support is in the range of 3.0 g/m$^2$ or less, preferably 2.7 g/m$^2$ or less, with the lower limit preferably being 1.0 g/m$^2$. These conditions reduce the coated film thickness of the emulsion layer, enabling a rapid processing and hence accomplishing the effects of the present invention more effectively.

Further, the effects of the present invention can be effectively accomplished, particularly, when the processing of the photographic material is rapidly conducted by conveying the photographic material at a line speed of 1,500 mm/min or more and completing all the steps of development, fixing, rinse and drying within 60 seconds in a roller type automatic processor. The upper limit of the line speed is preferably 4000 mm/min.

As the iridium compound to be used in the present invention, a water-soluble iridium compound may be used. Examples of such a water-soluble iridium compound include halogenated iridium (III) compound, halogenated iridium (IV) compound, and iridium complex salt containing halogen, amine, oxalate as ligands such as hexachloroiridium (III) or (IV) complex salt, hexammineiridium (III) or (IV) complex salt, and trioxalateiridium (III) or (IV) complex salt. In the present invention, among these compounds, trivalent and tetravalent compounds may be used alone or any combination thereof. Such an iridium compound may be used in the form of solution in water or a an appropriate solvent. In order to stabilize the solution of an iridium compound, a commonly used method, i.e., a method which comprises addition of an aqueous solution of hydrogen halide (e.g., hydrochloric acid, bromic acid, fluoric acid) or alkali halide (e.g., KCl, NaCl, KBr, NaBr) may be used. Instead of using such a water-soluble iridium compound, grains of another silver halide doped with iridium may be dissolved in the system during the preparation of silver halide grains.

The amount of the iridium compound of the present invention to be incorporated in the silver halide emulsion layer nearest to the support is in the range of $1\times10^{-8}$ mol or more, preferably $1\times10^{-8}$ to $1\times10^{-5}$ mol, most preferably $5\times10^{-8}$ to $5\times10^{-6}$ mol per mol of silver halide. The amount of the iridium compound of the present invention to be incorporated in the silver halide emulsion layer located further from to the support can be set to any range falling below that of the silver halide emulsion layer nearer to the support, but, as long as the general requirement is satisfied, it is preferably in the range of 0 to $4\times10^{-6}$ mol per mol of silver halide. The content of iridium the upper silver halide layer is located further from the support preferably in the range of 0 to 90%, particularly 5 to 80% of that of the lower silver halide layer located nearer the support.

The addition of such an iridium compound to the system may be effected at any convenient time during the preparation of silver halide emulsion or in various steps before coating of the emulsion. In particular, such an iridium compound may be preferably added to the system during the formation of grains so that it is incorporated in silver halide grains. Such an iridium compound may be used in combination with a compound containing a group VIII element other than iridium.

Examples of the light-sensitive silver halide to be used in the present invention include those comprising chloride, bromide and/or iodide such as silver bromide, silver chloride, silver bromoiodide, silver bromochloride and silver bromochloroiodide. In the case of silver bromoiodide or silver bromochloroiodide, the content of silver iodide is in the range of greater than 0 to 3 mol %, preferably greater than 0 to 1 mol %, and the content of silver chloride is in the range of greater than 0 to 95 mol %, preferably greater than 0 to 50 mol %.

As to the case of silver bromochloride, the content of silver chloride is in the range of 5 to 95 mol %, preferably 5 to 50 mol %.

In the crystalline structure of silver halide grains, the grain may be heterogeneous or homogeneous from core to shell.

In the silver halide grains to be used in the present invention, the 100 plane/111 plane ratio is preferably 2 or more, particularly preferably 3 or more, and even more preferably, 4 or more. In this ratio, the proportion of 100 plane may be 100%. Silver halide grains having a 100 plane/111 plane ratio of 3 or more, preferably 4 or more may be preferably contained in an amount of 50 wt % or more, particularly 80 wt % or more of total grains.

The preparation of silver halide grains of the present invention having a 100 plane/111 plane ratio of 2 or more can be accomplished by various methods mentioned below. In the most general method, an aqueous solution of silver nitrate and an aqueous solution of an alkali halide are simultaneously added to the system at a rate higher than the dissolving rate of grains that prevents renucleation while the pAg value of the system is kept to 8.1 or less during the formation of grains (so-called controlled double jet process). The pAg value of the system is preferably kept to 7.8 or less, more preferably 7.6 or less.

The pAg value of the system during the formation of silver halide nuclei is not specifically limited. The pAg value of the system during the growth of grains is in the range of 8.1 or less, preferably 7.8 or less, more preferably 7.6 or less, with the lower limit preferably being 6.5.

The reaction of the aqueous solution of silver nitrate and the aqueous solution of an alkali halide may be effected by a single jet process but may be preferably effected by a double jet process to provide an excellent monodispersibility.

These emulsion grains may be coarse or finely divided grains or a mixture thereof. These emulsion grains may preferably comprise grains having an average grain diameter (as determined by a projection method in terms of number-average grain diameter) of about 0.1 μm, preferably 0.2 μm to 0.8 μm. The crystal form of these emulsion grains is preferably cubic but may be any irregular crystal form such as sphere, potato-like form, tablet and plate having an aspect ratio of 5 or more (e.g., see Research Disclosure Item No. 22534, pp. 20–58).

The aforementioned silver halide emulsion may be used being mixed with a substantially light-insensitive silver halide emulsion (e.g., an internally fogged, finely divided emulsion). Of course, silver halide emulsions having different grain sizes or other properties may be separately coated as separate layers in the photographic element to enlarge the exposure latitude.

The grain size distribution may be preferably narrow, i.e., so-called monodisperse. More particularly, such a monodisperse emulsion preferably comprises grains 90% or more of which fall within a range between ±40%, preferably ±20% of the overall average grain size.

In order to control the growth of grains during the formation of silver halide grains, as a silver halide solvent there may be used ammonia, potassium thiocyanate, ammonium thiocyanate, thioether (as disclosed in U.S. Pat. Nos. 3,271,157, 3,574,628, 3,704,130, 2,297,439, 4,276,374), thione compound (as disclosed in JP-A-53-144319, 53-82408, 55-77737), amine compound (as disclosed in JP-A-54-100717), thiourea compound (as disclosed in U.S. Pat. No. 4,221,863) or the like.

Besides these silver halide solvents, a compound which is adsorbed to the surface of grains to control the crystal habit, such as cyanine sensitizing dye, tetrazaindene and mercapto compound may be used during the formation of grains.

The emulsion to be used in the present invention may be subjected to a commonly used chemical sensitization such as sulfur sensitization (as disclosed in U.S. Pat. Nos. 1,574,944, 2,278,947, 3,021,215, 3,635,717), reduction sensitization (as disclosed in U.S. Pat. No. 2,518,698, Research Disclosure Vol. 176 (December 1978) No. 17643, Section 3), sensitization with thioether compound (as disclosed in U.S. Pat. Nos. 2,521,926, 3,021,215, 3,046,133, 3,165,552, 3,625,697, 3,635,717, 4,198,240) and composite thereof.

Specific examples of chemical sensitizers include sulfur sensitizers such as sodium thiosulfate, allyl thiocarbamide, thiourea, thiosulfate, thioether and cystine, and reduction sensitizers such as tin chloride, phenyl hydrazine and reductone.

More preferably, the emulsion to be used in the present invention may be subjected to gold sensitization (as disclosed in U.S. Pat. Nos. 2,540,085, 2,399,083). Specific examples of gold sensitizers include potassium chloroaurate, auras thiosulfate, and potassium chloroparadate. These gold compounds may be added to the system before, after or simultaneous with the addition of the sulfur sensitizer.

The amount of the gold sensitizer of the present invention to be used is preferably in the range of $10^{-7}$ to $10^{-3}$ mol, more preferably $10^{-6}$ to $10^{-4}$ mol per mol of silver halide.

The sensitizing dye having an absorption in the wavelength range of 600 nm or more, which can be preferably used for the silver halide emulsions of the present invention, exhibits an optimum spectral sensitivity to a He-Ne laser, a semiconductor laser or the like and is represented by the general formulae (I), (II), (III) or (IV) below. However, if these sensitizing dyes are used alone singly, they tend to lack optical spectral sensitizing effect. For instance, as the amount of these sensitizing dyes is increased, they tend to increasingly cause inherent desensitization. It is known to use various supersensitizers in combination with these sensitizing dyes in order to cope with and counteract such a problem. Examples of these supersensitizers are described in JP-B-60-45414, and 46-10473 (The term "JP-B" as used herein means an "examined Japanese patent publication"), and JP-A-59-192242.

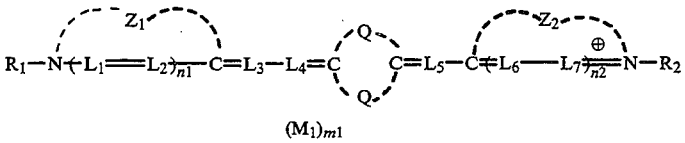

(I)

$(M_1)_{m1}$

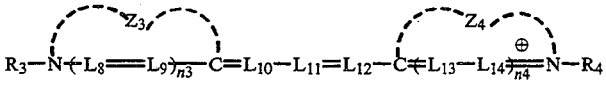

(II)

$(M_2)_{m2}$

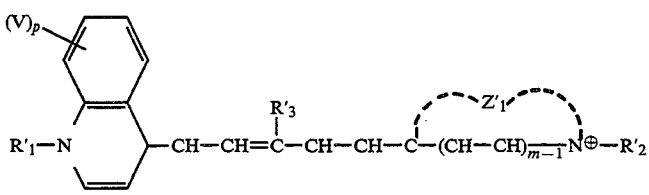

(III)

$(X_1^{\ominus})_{q-1}$

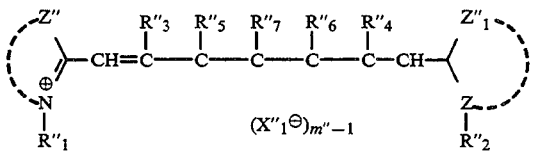

(IV)

$(X''^{\ominus}_1)_{m''-1}$

These general formulae will be further described herein below beginning with the general formulae (I) and (II).

In the general formulae (I) and (II), $R_1$, $R_2$, $R_3$ and $R_4$ each represents an alkyl group and an unsubstituted alkyl group. Preferred examples include an unsubstitued alkyl group having 18 carbon atoms or less (e.g., methyl, ethyl, propyl, butyl, pentyl, octyl, decyl, dodecyl, octadecyl) and a substituted alkyl group having 18 carbon atoms or less substituted by a substituent. Examples of the substituent include a carboxyl group, a sulfo group, a cyano group, a halogen atom (e.g., fluorine, chlorine, bromine), a hydroxyl group, an alkoxycarbonyl group having 8 carbon atoms or less (e.g., methoxycarbonyl, ethoxycarbonyl, phenoxycarbonyl, benzyloxycarbonyl), an alkoxy group having 8 carbon atoms or less (e.g., methoxy, ethoxy, benzyloxy, phenethyloxy), a monocyclic aryloxy group having 10 carbon atoms or less (e.g., phenoxy, p-tolyloxy), an acyloxy group having 3 carbon atoms or less (e.g., acetyloxy, propionyloxy), an acyl group having 8 carbon atoms or less (e.g., acetyl, propionyl, benzoyl, mesyl), a carbamoyl group (e.g., carbamoyl, N,N-dimethylcarbamoyl, morpholinocarbonyl, piperidinocarboyl), a sulfamoyl group (e.g., sulfamoyl, N,N-dimethylsulfamoyl, morpholinosulfonyl, piperidinosulfonyl), an ary group having 10 carbon atoms or less (e.g., phenyl, 4-chlorophenyl, 4-methylphenyl, α-naphtyl). Particularly preferred examples of $R_1$, $R_2$, $R_3$ and $R_4$ include an unsubstituted alkyl group (e.g., methyl, ethyl, n-propyl, n-butyl, n-pentyl, n-hexyl), a carboxyalkyl group (e.g., 2-carboxyethyl, carboxymethyl) and a sulfoalkyl group (e.g., 2-sulfoethyl, 3-sulfopropyl, 4-sulfobutyl, 3-sulfobutyl).

$Z_1$, $Z_2$, $Z_3$ and $Z_4$ each represents an atomic group necessary for the formation of a 5- or 6-membered nitrogen-containing heterocycle. Q and Q' each represents an atomic group necessary for the formation of a 5- or 6-membered nitrogen-containing heterocycle with each other. $L_1$, $L_2$, $L_3$, $L_4$, $L_5$, $L_6$, $L_7$, $L_8$, $L_9$, $L_{10}$, $L_{11}$, $L_{12}$, $L_{13}$ and $L_{14}$ each represents a substituted or unsubstituted methine group. The suffixes $n_1$, $n_2$, $n_3$ and $n_4$ each represents an integer 0 or 1. $M_1$ and $M_2$ each represents a charge neutralizing paired ion. The suffixes $m_1$ and $m_2$ each represents an integer of 0 or more necessary for the neutralization of charge in the molecule.

$L_1$, $L_2$, $L_3$, $L_4$, $L_5$, $L_6$, $L_7$, $L_8$, $L_9$, $L_{10}$, $L_{11}$, $L_{12}$, $L_{13}$ and $L_{14}$ each represent an unsubstituted methine group or a substituted methine group substituted by, for example, a susbtituted or unsubstituted alkyl group (e.g., methyl, ethyl, 2-carboxyethyl), a substituted or unsubstituted aryl group (e.g., phenyl, o-carboxyphenyl), a heterocyclic group (e.g., barbituric acid), a halogen atom (e.g., chlorine, bromine), an alkoxy group (e.g., methoxy, ethoxy), an amino group (e.g., N,N-diphenylamino, N-methyl-N-phenylamino, N-methylpiperidino), an alkylthio grop (e.g., methylthio, ehtylthio), which may form a ring together with another methine group or may form a ring together with a coloring aid moiety.

$L_3$, $L_5$, $L_{10}$, and $L_{12}$ each preferably represents an unsubstituted methine group.

$L_4$ preferably represents an unsubstituted methine group and a methine group substituted by an unsubstituted alkyl group (e.g., methyl, ethyl).

$L_{11}$ preferably represents an unsubstituted methine group and a substituted methine group (preferably those substituted by a lower alkyl group (preferably having 1 to 4 carbon atoms, e.g., methyl, ethyl, propyl, butyl), a lower alkoxyl group (preferably having 1 to 4 carbon atoms, e.g., methoxy, ethoxy, propoxy, butoxy), a phenyl group, a benzyl group, or a phenethyl group), and more preferably represents a substituted methine group (e.g., those substituted by a methyl group, an ethyl group, a benzyl group, or a phenyl group).

The general formula (III) is described below.

In the general formula (III), $R_1'$ and $R_2'$, which may be the same or different, each represents an alkyl group (including a substituted alkyl group).

$R_3'$ represents a hydrogen atom, a lower alkyl group ($C_{1-4}$), a lower alkoxy group ($C_{1-4}$), a phenyl group, a benzyl group or a phenethyl group. In particular, a lower alkyl group or a benzyl group may be advantageously used.

V represents a hydrogen atom, a lower alkyl group, an alkoxy group, a halogen atom or a substituted alkyl group.

$Z'_1$ represents a nonmetallic atomic group necessary for the formation of a 5- or 6-membered nitrogen-containing heterocycle. Among these nonmetallic atomic groups, a thiazole nucleus and an oxazole nucleus may be advantageously used. More preferably, a benzothiazole nucleus, a naphthothiazole nucleus, a naphthooxazole nucleus or a benzooxazole nucleus may be advantageously used. The suffixes m, p and q each independently represents an integer 1 or 2.

However, if the dye forms an intramolecular salt, q is 1.

$X_1$ represents an acid anion.

The general formula (IV) will now be described.

In the general formula (IV), $R_1''$ and $R_2''$, which may be the same or different, each represents an unsubstituted alkyl group (preferably having 8 carbon atoms or less) or a substituted alkyl group (preferably having 6 carbon atoms or less in the alkyl moiety). Examples of the substituent include a carboxyl group, a sulfo group, a cyano group, a halogen atom (e.g., fluorine, chlorine, bromine), a hydroxyl group, an alkoxycarbonyl group (preferably those having 8 carbon atoms or less, e.g., methoxycarbonyl, ethoxycarbonyl, benzyloxycarbonyl), an alkoxy group (preferably having 7 carbon atoms or less, e.g., methoxy, ethoxy, propoxy, butoxy, benzyloxy), an aryloxy group (e.g., phenoxy, p-tolyloxy), an acyloxy group (preferably having 3 carbon atoms or less, e.g., acethyloxy, propionyloxy), an acyl group (preferably having 8 carbon atoms or less, e.g., acetyl, propyonyl, benzoyl, mesyl), a carbamoyl group (e.g., carbamoyl, N,N-dimethylcarbamoyl, morpholinocarbamoyl, piperidinocarbamoyl), a sulfamoyl group (e.g., sulfamoyl, N,N-dimethylsulfamoyl, morpholinosulfamoyl), and an ary group (e.g., phenyl, p-hydroxyphenyl, p-carboxyphenyl, p-sulfophenyl, α-naphtyl). The alkyl group of $R_1''$ and $R_2''$ may be substituted by two or more of these substituents in combination.

$R_3''$ and $R_4''$ each represents a hydrogen atom, a lower alkyl group ($C_1$ to $C_4$), a lower alkoxy group ($C_1$ to $C_4$), a phenyl group, a benzyl group or a phenethyl group. In particular, a lower alkyl group or a benzyl group may be advantageously used.

$R_5''$ and $R_6''$ each represents a hydrogen atom. Alternatively, $R_5''$ and $R_6''$ are connected to each other to form a divalent alkylene group.

$R_7''$ represents a hydrogen atom, a lower alkyl group ($C_{1-4}$), a lower alkoxy group ($C_{1-4}$), a phenyl group, a benzyl group or $—N(W_1')(W_2')$. $W_1'$ and $W_2'$ each independently represents an alkyl group (preferably from $C_{1-4}$)(including substituted alkyl group) or aryl group (preferably from $C_{1-12}$) (including substituted phenyl group). Alternatively, $W_1'$ and $W_2'$ may be connected to each other to form a 5- or 6-membered nitrogen-containing heterocycle. $R_3''$ and $R_7''$ or $R_4''$ and $R_7''$ may be connected to each other to form a divalent alkyl group having the same meaning as that formed by the connection of $R_5''$ and $R_6''$.

$Z''$ and $Z_1''$ each represents a nonmetallic atomic group necessary for the formation of a 5- or 6-membered nitrogen-containing heterocycle. Among these nonmetallic atomic groups, a thiazole nucleus and an oxazole nucleus may be advantageously used. More preferably, a benzothiazole nucleus, a napthothiazole nucleus, a naphthooxazole nucleus or a benzooxazole nucleus may be advantageously used.

$X_1''$ represents an acid anion.

The suffix m'' represents an integer 0 or 1. When the dye forms an intramolecular salt, m'' is 1.

For more details on the general formulae (I) to (IV), reference can be made to Japanese Patent Application No. 4-29892.

Specific examples of the sensitizing dye of the present invention will be given below, but the present invention should not be construed as being limited thereto.

I-1

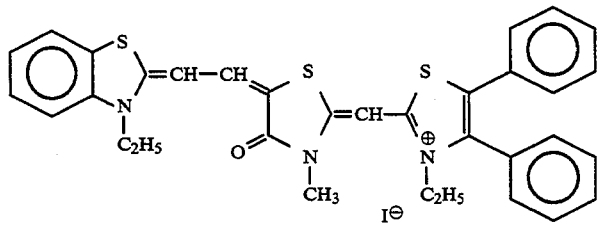

I-2

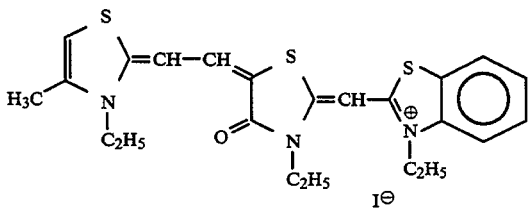

-continued
I-3
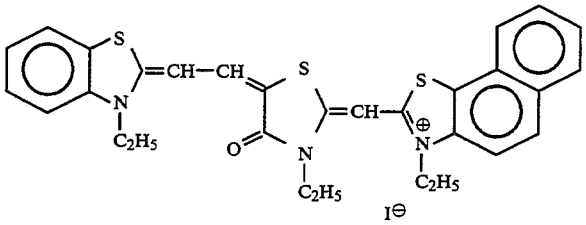
I-4
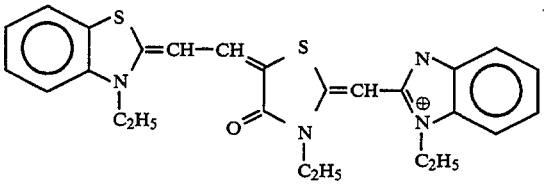
II-1
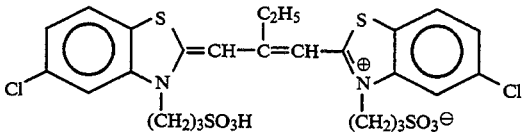
II-2
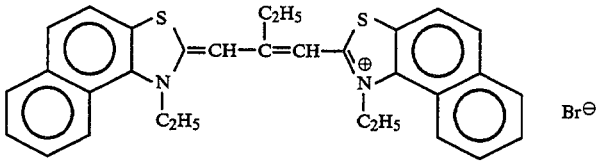
II-3
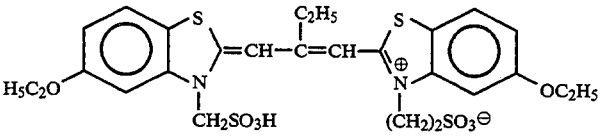
II-4
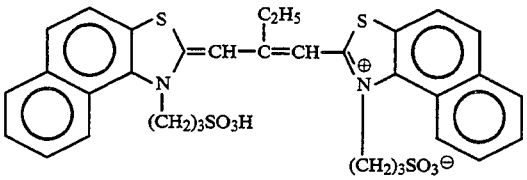
II-5
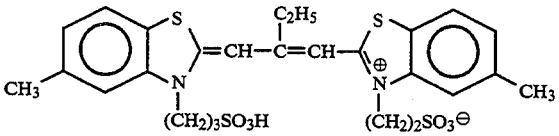
II-6
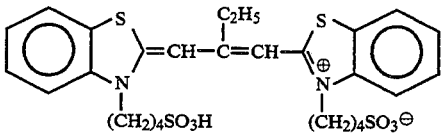
II-7
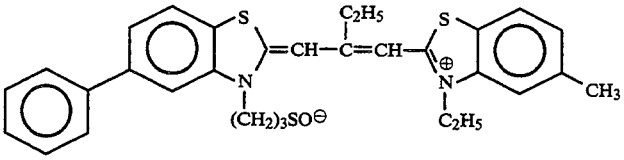

-continued
II-8
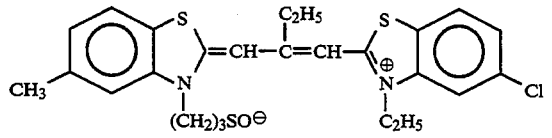
III-1
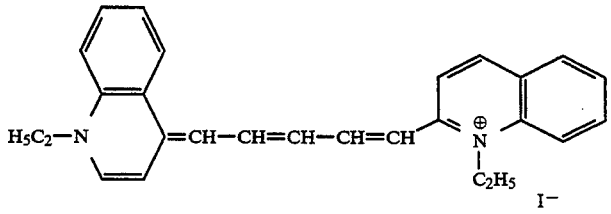
III-2
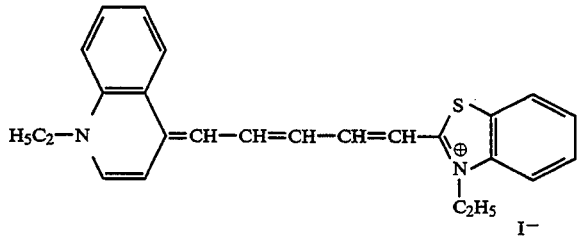
III-3
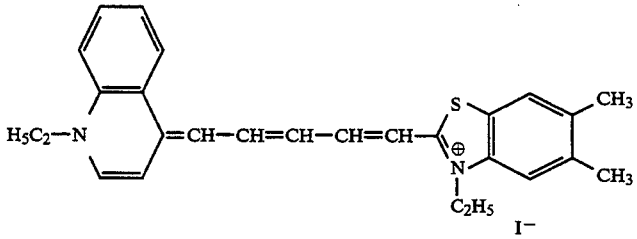
III-4
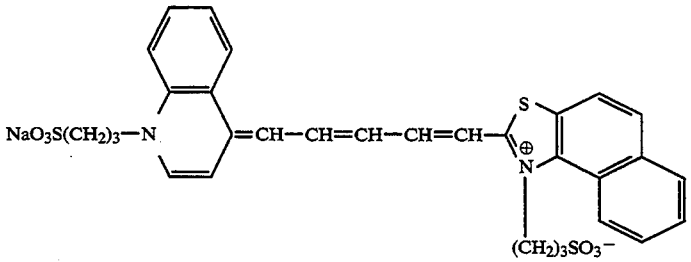
III-5
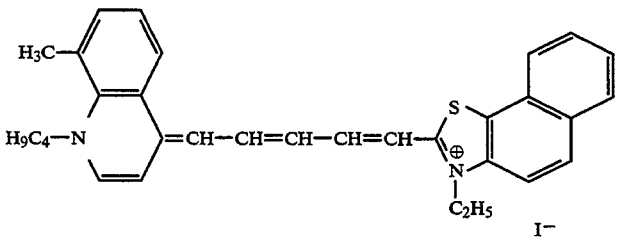
III-6
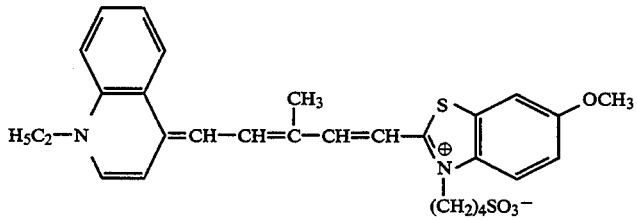

-continued
III-7
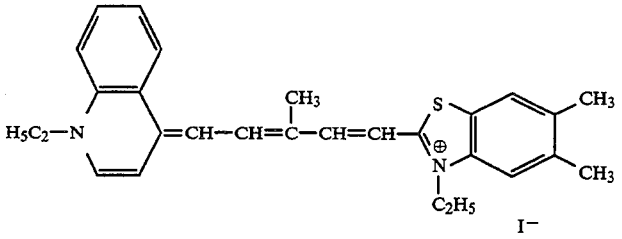
III-8
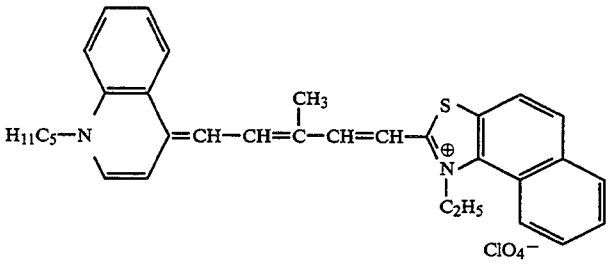
III-9
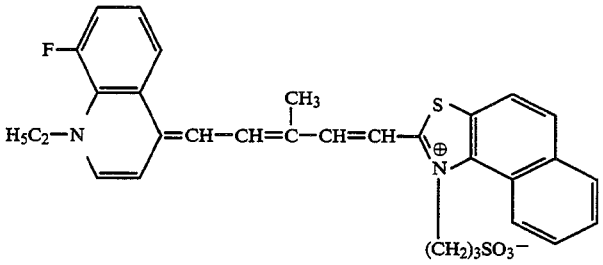
III-10
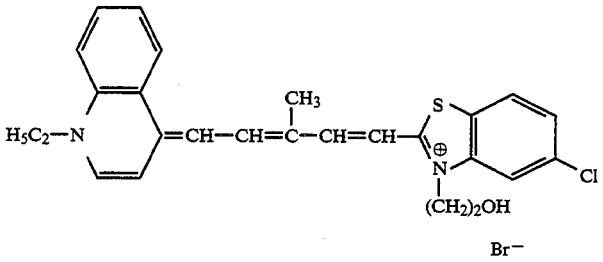
III-11
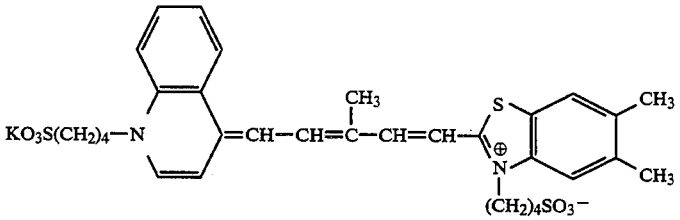
III-12
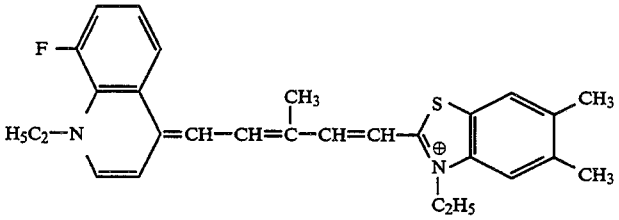

-continued
III-13
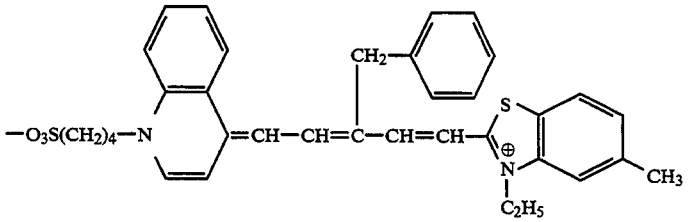
III-14
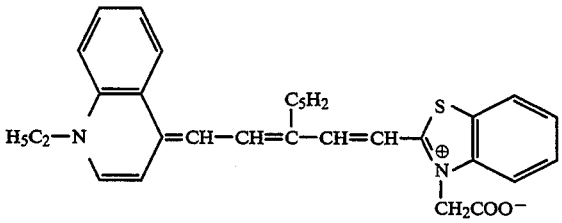
III-15
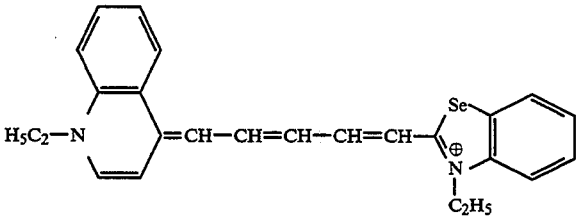
I−
III-16
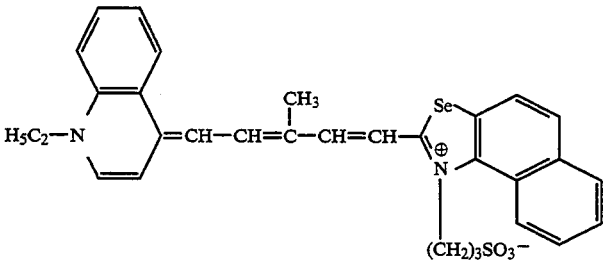
III-17
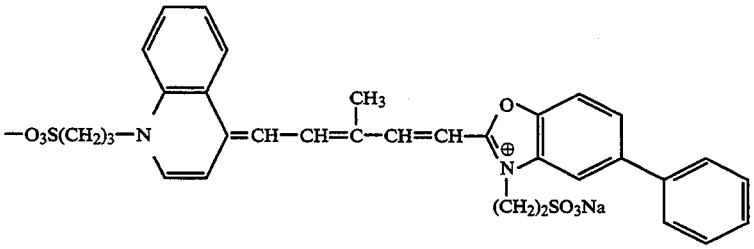
III-18
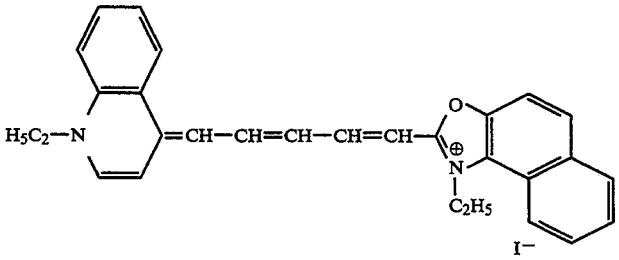
I−

-continued
III-19
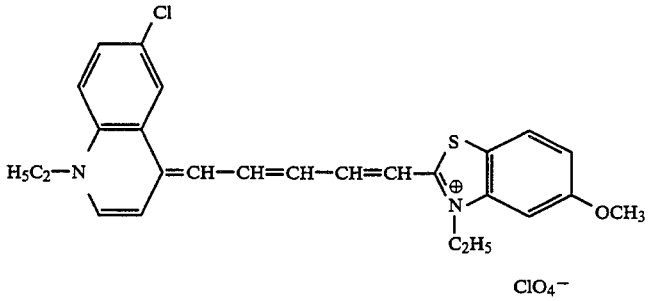
III-20
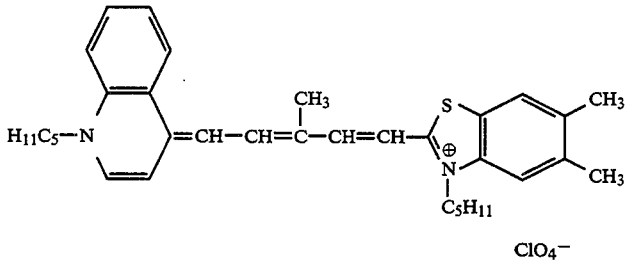
IV-1
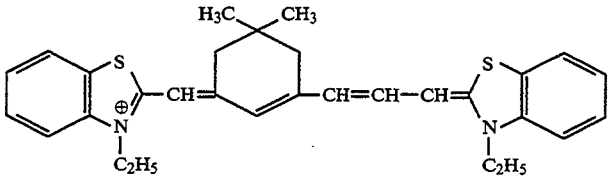
IV-2
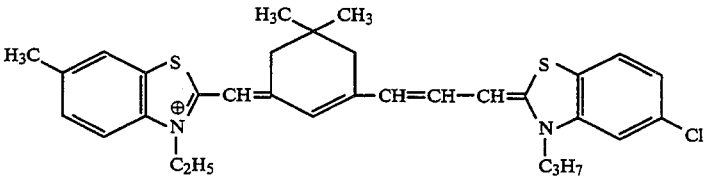
IV-3
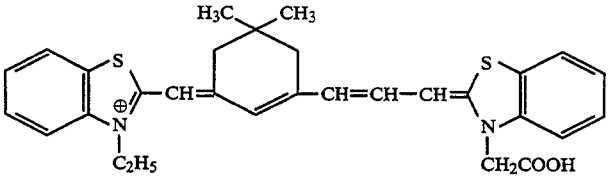
IV-4
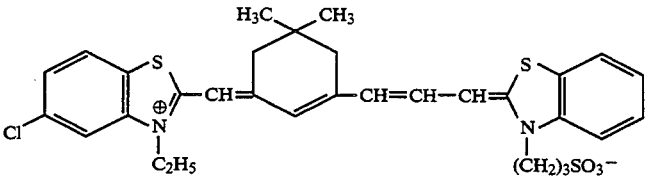
IV-5
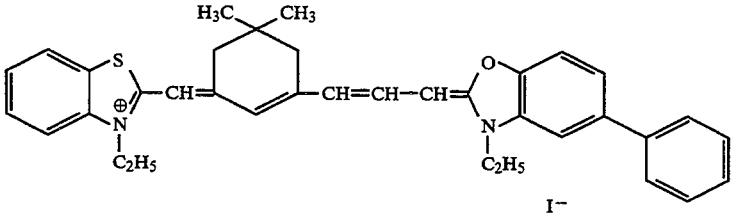

-continued
IV-6
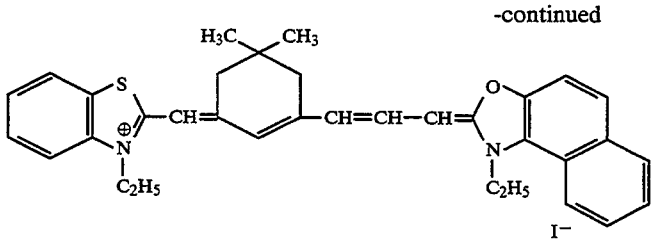
IV-7
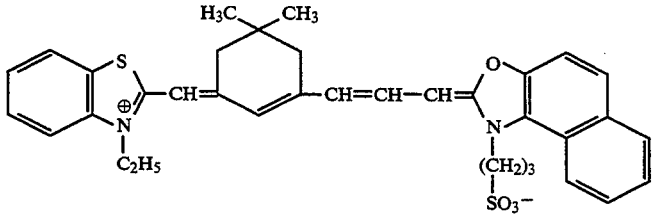
IV-8
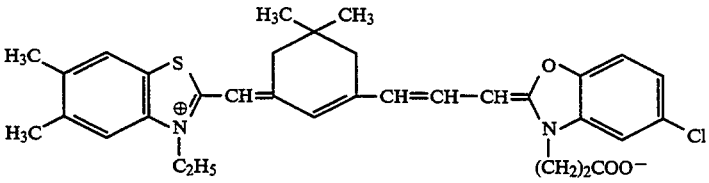
IV-9
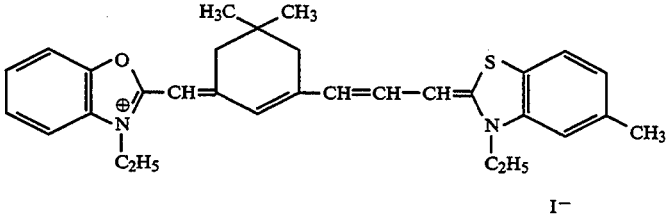
IV-10
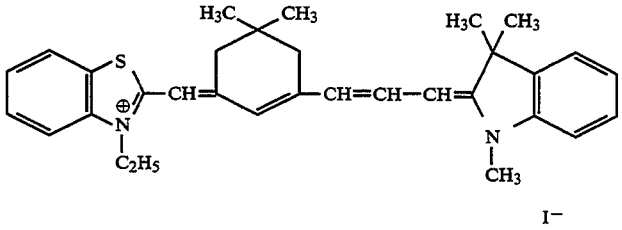
IV-11
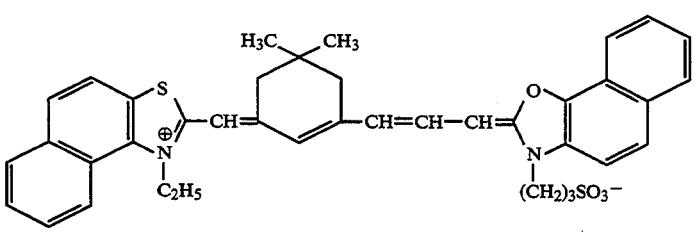
IV-12
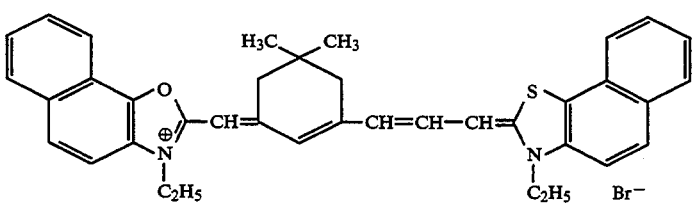
IV-13
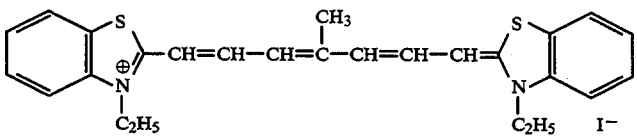

-continued
IV-14
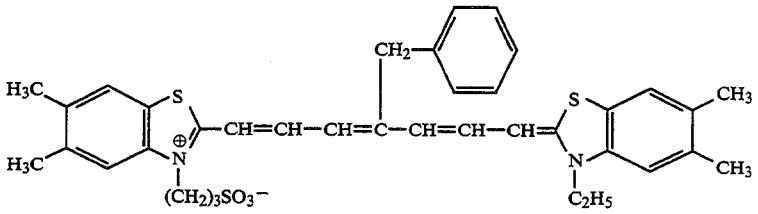
IV-15
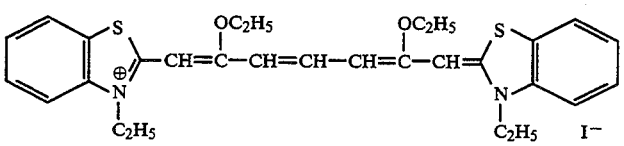
IV-16
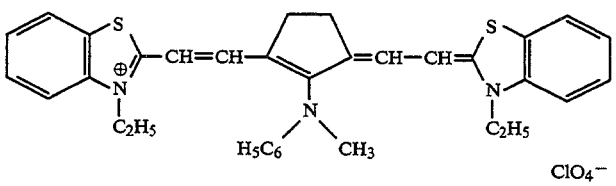
IV-17
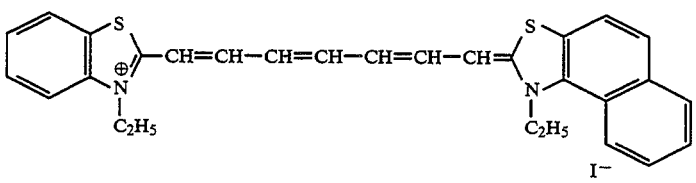
IV-18
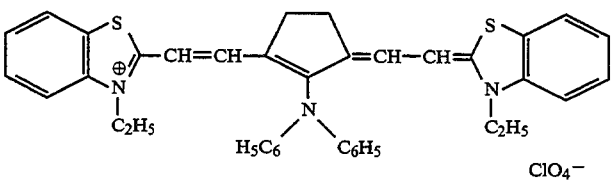
IV-19
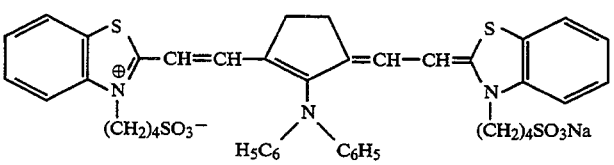
IV-20
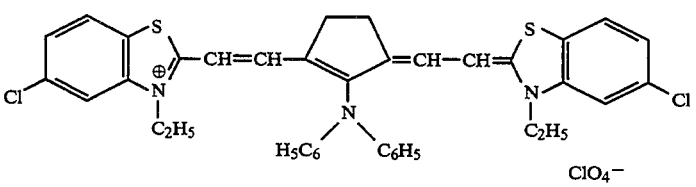
IV-21
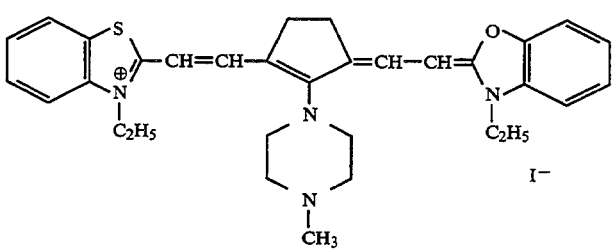

-continued

IV-22

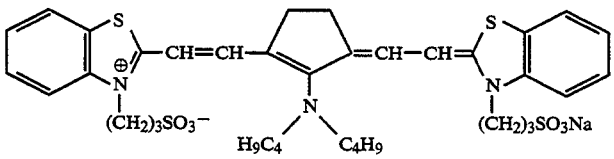

These sensitizing dyes may be used singly or in combination. Such a combination of sensitizing dyes is often used for the purpose of supersensitization, as can be understood by one of skill in the field. In combination with such a sensitizing dye, a dye which does not exhibit a spectral sensitizing effect itself or a substance which does not substantially absorb visible light and exhibits a supersensitizing effect may be incorporated in the emulsion.

Examples of useful sensitizing dyes, combination of supersensitizing dyes and supersensitizing substances are described, for example, in Research Disclosure No. 17643, vol. 176, p. 23, IV-J, December 1978, JP-B-49-25500, and 43-4933, and JP-A-59-19032, and 59-192242.

The optimum content of the sensitizing dye of the present invention having an absorption in the wavelength range of 600 nm or more may be preferably selected depending on, for example, the grain diameter, halogen composition and method and extent of chemical sensitization of silver halide emulsion, the relationship between the layer in which the sensitizing compound of the present invention is incorporated and the silver halide emulsion, the kind of fog inhibiting compound used. The testing method for the selection of the optimum value is well known by those skilled in the art.

In general, the sensitizing dye of the present invention may be preferably used in an amount of $10^{-7}$ to $1\times10^{-2}$ mol, particularly $10^{-6}$ to $5\times10^{-3}$ mol per mol of silver halide.

In the present invention, a compound represented by the general formula (V) may be further used as a supersensitizer.

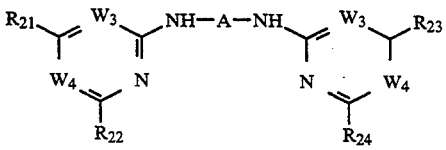

(V)

wherein —A— represents a divalent aromatic residue which may contain —$SO_3M$ group (in which M represents a hydrogen atom or cation that renders the compound water-soluble, e.g., sodium, potassium).

As —A— there may be preferably used one selected from the group consisting of —$A_1$— or —$A_2$— below. However, if all of $R_{21}$, $R_{22}$, $R_{23}$ and $R_{24}$ are free of —$SO_3M$, —A— is selected from the group consisting of —$A_1$—.

—$A_1$—:

—$A_1$—:

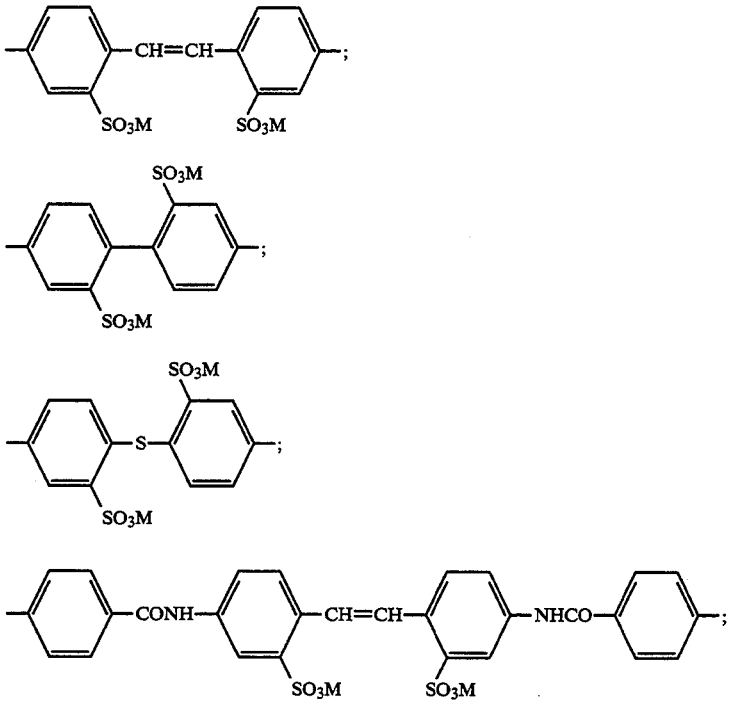

-continued

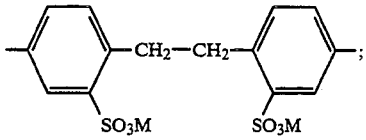

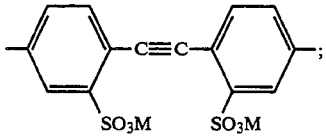

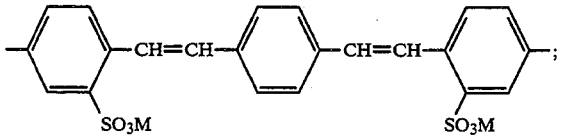

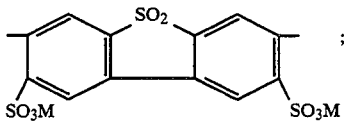

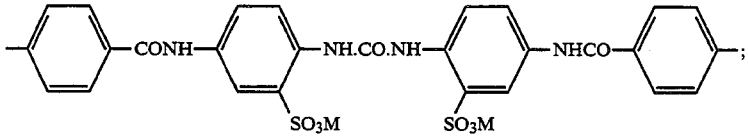

(wherein M represents a hydrogen atom or a cation that renders the compound water-soluble)

$—A_2—$:

$—A_z—$:

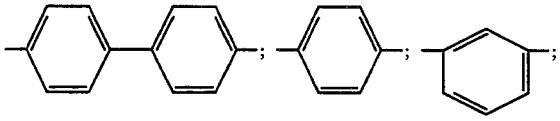

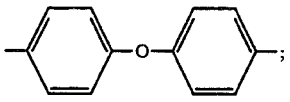

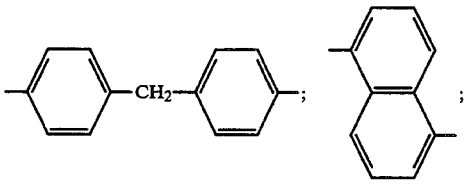

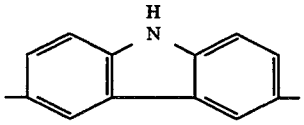

$R_{21}$, $R_{22}$, $R_{23}$ and $R_{24}$ each represents a hydrogen atom, hydroxyl group, lower alkyl group (preferably $C_{1-8}$ alkyl group, e.g., methyl, ethyl, n-propyl, n-butyl), alkoxy group (preferably $C_{1-8}$ alkoxy group, e.g., methoxy, ethoxy, propoxy, butoxy), aryloxy group (e.g., phenoxy, naphthoxy, o-troxy, p-sulfophenoxy), halogen atom (e.g., chlorine, bromine), heterocyclic nucleus (e.g., morpholinyl, piperidyl), alkylthio group (e.g., methylthio, ethylthio), heterocyclylthio group (e.g., benzothiazolylthio, benzoimidazolylthio, phenyltetrazolylthio), arylthio group (e.g., phenylthio, tolylthio), amino group, alkylamino group or substituted alkylamino group (e.g., methylamino, ethylamino, propylamino, dimethylamino, diethylamino, dodecylamino, cyclohexylamino, β-hydroxyethylamino, di-(β-hydroxyethyl)amino, β-sulfoethylamino), arylamino group or substituted arylamino group (e.g., anilino, o-sulfoanilino, m-sulfoanilino, p-sulfoanilino, o-toluidino, m-toluidino, p-toluidino, o-carboxyanilino, m-carboxyanilino, p-carboxyanilino, o-chloroanilino, m-chloroanilino, p-chloroanilino, p-aminoanilino, o-anisidino, m-anisidino, p-anisidino, o-acetaminoanilino, hydroxyanilino, disulfophenylamino, naphthylamino, sulfonaphthylamino), heterocyclylamino group (e.g., 2-benzothiazolylamino, 2-pyridylamino), substituted or unsubstituted aralkylamino group (e.g., benzylamino, o-anisylamino, m-anisylamino, p-anisylamino), aryl group (e.g., phenyl), or mercapto group. $R_{21}$, $R_{22}$, $R_{23}$ and $R_{24}$ may be the same or different. If —A— is $—A_2—$, at least one of $R_{21}$, $R_{22}$, $R_{23}$ and $R_{24}$ needs to contain one or more sulfo groups (which may be in the form of free acid group or may form a salt). $W_3$ and $W_4$ each represents —CH= or —N=, with the proviso that at least one of $W_3$ and $W_4$ is —N=.

The added amount of the compound represented by formula (V) is generally in the range of $10^{-5}$ to $10^{-1}$ mol per mol of silver.

Specific examples of the compound represented by the general formula (V) will be given below, but the present invention should not be construed as being limited thereto.

(V-1) Disodium 4,4'-bis(4,6-di(benzothiazolyl-2-thio)-pyrimidine-2-ylamino)stilbene-2,2'-disulfonate
(V-2) Disodium 4,4'-bis(4,6-di(benzothiazolyl-2-amino)-pyrimidine-2-ylamino)stilbene-2,2'-disulfonate
(V-3) Disodium 4,4'-bis(4,6-di(naphthyl-2-oxy)pyrimidine-2-ylamino)stilbene-2,2'-disulfonate
(V-4) Disodium 4,4'-bis(4,6-di(naphthyl-2-oxy)pyrimidine-2-ylamino)bibenzyl-2,2'-disulfonate
(V-5) Disodium 4,4'-bis(4,6-dianilinopyrimidine-2-ylamino)stilbene-2,2'-disulfonate
(V-6) Disodium 4,4'-bis(4-chloro-6-(2-naphthyloxy)-pyrimidine-2-ylamino)biphenyl-2,2'-disulfonate
(V-7) Disodium 4,4'-bis(4,6-di(1-phenyltetrazolyl-5-thio)pyrimidine-2-ylamino)stilbene-2,2'-disulfonate
(V-8) Disodium 4,4'-bis(4,6-di(benzoimidazolyl-2-thio)-pyrimidine-2-ylamino)stilbene-2,2'-disulfonate
(V-9) Disodium 4,4'-bis(4,6-diphenoxypyrimidine-2-ylamino)stilbene-2,2'-disulfonate
(V-10) Disodium 4,4'-bis(4,6-diphenylthiopyrimidine-2-ylamino)stilbene-2,2'-disulfonate
(V-11) Disodium 4,4'-bis(4,6-dimercaptopyrimidine-2-ylamino)biphenyl-2,2'-disulfonate
(V-12) Disodium 4,4'-bis(4,6-dianilino-triazine-2-ylamino)stilbene-2,2'-disulfonate
(V-13) Disodium 4,4'-bis(4-anilino-6-hydroxy-triazine-2-ylamino)stilbene-2,2'-disulfonate
(V-14) Disodium 4,4'-bis(4-naphthylamino-6-anilino-triazine-2-ylamino)stilbene-2,2'-disulfonate
(V-15) 4,4'-Bis(2,6-di(2-naphthoxy)pyrimidine-4-ylamino)stilbene-2,2'-disulfonic acid
(V-16) Disodium4,4'-bis(2,6-di(2-naphthylamino)-pyrimidine-4-ylamino)stilbene-2,2'-disulfonate
(V-17) Disodium 4,4'-bis(2,6-dianilinopyrimidine-4-ylamino)stilbene-2,2'-disulfonate
(V-18) 4,4'-Bis(2-naphthylamino) -6-anilinopyrimidine-4-ylamino)stilbene-2,2'-disulfonic acid
(V-19) Ditriethylammonium 4,4'-bis(2,6-diphenoxypyrimidine-4-ylamino)stilbene-2,2'-disulfonate
(V-20) Disodium 4,4'-bis(2,6-di(benzoimidazolyl-2-thio)pyrimidine-4-ylamino) stilbene-2,2'-disulfonate The compounds represented by the general formula (V) are known or can be facilely prepared by known preparation methods.

Other various additives to be incorporated in the photographic material of the present invention are not specifically limited. For example, those described in references cited herein below can be used.

| Item | References |
|---|---|
| 1) Fog inhibitor, stabilizer | JP-A-2-68539, line 17, lower left column, p. 10-line 7, upper left column, p. 11; line 2, lower left column, p. 3-lower left column, p. 4 |
| 2) Color tone improver | JP-A-62-276539, line 7, lower left column, p. 2-line 20, lower left column, p. 10<br>JP-A-3-94249, line 15, lower left column, p. 6-line 19, upper right column, p. 11 |
| 3) Surface active agent, antistatic agent | JP-A-2-68539, line 14, upper left column, p. 11-line 9, upper left column, p. 12 |
| 4) Matting agent, lubricant, plasticizer | JP-A-2-68539, line 10, upper left column, p. 12-line 10, upper right column, p. 12; line 10, lower left column, p. 14-line 1, lower right column, p. 14 |
| 5) Hydrophilic colloid | JP-A-2-68539, line 11, upper right column, p. 12-line 16, lower left column, p. 12 |
| 6) Film hardener | JP-A-2-68539, line 17, lower left column, p. 12-line 6, upper right column, p. 13 |
| 7) Support | JP-A-2-68539, line 7-line 20, upper right column, p. 13 |
| 8) Dye, mordant | JP-A-2-68539, line 1, lower left column, p. 13-line 9, lower left column, p. 14<br>JP-A-3-24537, lower left column, p. 14-lower right column, p. 16 |
| 9) Polyhydroxybenzene | JP-A-3-39948, upper left column, p. 11-lower left column, p. 12<br>EP 452772A |
| 10) Layer configuration | JP-A-3-198041 |
| 11) Development process | JP-A-2-103037, line 7, upper right column, p. 16-line 15, lower left column, p. 19<br>JP-A-2-115837, line 5, lower right column, p. 3-line 10, upper right column, p. 6 |

The photographic material of the present invention exhibits excellent properties when processed rapidly by means of an automatic processor in which the line speed is 1,500 mm/min and the total processing time is from 15 seconds to 60 seconds.

In the rapid development process of the present invention, the development and fixing may be effected at a temperature of about 25° C. to 50° C. in 25 seconds or less, preferably at a temperature of 30° C. to 40° C. for 4 to 15 seconds, respectively.

In the present invention, the present invention light-sensitive material which has been developed and fixed is then subjected to rinse or stabilization. The rinse may be conducted in a 2 or 3-stage counter-current process to save water. When a small amount of washing water is used in the rinse, a squeeze roller washing tank is preferably provided. Further, the overflow solution from the washing tank or stabilizing tank may be partially or totally reused as fixing solution as described in JP-A-60-235133. This advantageously reduces the amount of waste water.

In the present invention, the photographic material which has been developed, fixed and washed is dried through a squeeze roller. The drying is effected at a temperature of 40° C. to 80° C. for 4 to 30 seconds.

The term "total processing time" as used herein means the time between the point at which the forward edge of the film is inserted into the intake of the automatic processor and the point at which it comes out from the drying outlet via a developing tank, a connecting zone, a fixing tank, a connecting zone, a washing tank, a connecting zone, and a drying zone.

Since the silver halide photographic material of the present invention can reduce the amount of gelatin to be used as a binder for emulsion layer and protective layer without impairing pressure fog, it can be developed without impairing the developing, fixing and drying speed even in a rapid processing process with a total processing time of 15 to 60 seconds.

The present invention will be further described in the following examples, but the present invention should not be construed as being limited thereto.

EXAMPLE 1

1. Preparation of Silver Halide Emulsion 40 g of gelatin was dissolved in 1 l of water and kept at a temperature of 53° C. To the solution were then added 5 g of sodium chloride, 0.4 g of potassium bromide, and 50 mg of the following compound (A):

$$HO-(CH_2)_2-S-(CH_2)_2-S-(CH_2)_2-OH$$

To the solution were then added 1,000 ml of an aqueous solution containing 200 g of silver nitrate and 1,080 ml of an aqueous solution containing potassium hexachloroiridiumate (III) in such an amount that the molar ratio of iridium to produced silver halide is $5\times10^{-7}$, 21 g of sodium chloride and 100 g of potassium bromide by a double jet process to prepare a monodisperse emulsion of cubic silver bromochloride grains having an average grain size of 0.4 μm. The emulsion was then desalted. 40 g of gelatin was then added to the emulsion. The pH value and pAg value of the emulsion were then adjusted to 6.0 and 8.5, respectively. The emulsion was then subjected to chemical sensitization with 2.5 mg of sodium thiosulfate and 4 mg of chloroauric acid at a temperature of 60° C. To the emulsion was then added 0.2 g of 4-hydroxy-6-methyl-1,3,3a,7-tetrazaindene. The emulsion was then rapidly cooled and solidified to prepare Emulsion A.

A monodisperse emulsion of cubic silver bromochloride grains having an average grain size of 0.3 μm was prepared in the same manner as Emulsion A except that the compound (A) was used in an amount of 35 mg. The emulsion thus obtained was then desalted. To the emulsion was then added 40 g of gelatin. The pH value and pAg value of the emulsion were thus adjusted to 6.0 and 8.5, respectively. The emulsion was then subjected to chemical sensitization with 2.5 mg of sodium thiosulfate and 4 mg of chloroauric acid at a temperature of 60° C. To the emulsion was then added 0.2 g of 4-hydroxy-6-methyl-1,3,3a,7-tetrazaindene. The emulsion was then rapidly cooled and solidified to prepare Emulsion B.

An emulsion of grains having an average grain size of 0.4 μm was prepared in the same manner as Emulsion A except that the amount of potassium hexachloroiridiumate (III) was such that the molar ratio of iridium to produced silver halide is $1.5\times10^{-7}$ to prepare Emulsion C.

An emulsion of grains having an average grain size of 0.3 μm was prepared in the same manner as Emulsion B except that the amount of potassium hexachloroiridiumate (III) was such that the molar ratio of iridium to produced silver halide is $1.5\times10^{-7}$ to prepare Emulsion D.

An emulsion of grains having an average grain size of 0.4 μm was prepared in the same manner as Emulsion A except that the amount of potassium hexachloroiridiumate (III) was such that the molar ratio of iridium to produced silver halide is $5\times10^{-8}$ to prepare Emulsion E.

An emulsion of grains having an average grain size of 0.3 μm was prepared in the same manner as Emulsion B except that the amount of potassium hexachloroiridiumate (III) was such that the molar ratio of iridium to produced silver halide is $5\times10^{-8}$ to prepare Emulsion F.

Emulsions of grains having an average grain size of 0.36 μm were prepared in the same manner as Emulsions A and C except that the compound (A) was used in an amount of 42 mg to Emulsions G andd H, respectively.

The grain size and iridium content of these emulsions are set forth in Table 1.

TABLE 1

| Emulsion | Average grain size (μm) | Iridium content (per mol Ag) | $S_{1.0}$ (90″) |
|---|---|---|---|
| A | 0.40 μm | $5\times10^{-7}$ mol | 105 |
| B | 0.30 μm | $5\times10^{-7}$ mol | 40 |
| C | 0.40 μm | $1.5\times10^{-7}$ mol | 125 |
| D | 0.30 μm | $1.5\times10^{-7}$ mol | 50 |
| E | 0.40 μm | $5\times10^{-8}$ mol | 165 |
| F | 0.30 μm | $5\times10^{-8}$ mol | 60 |
| G | 0.35 μm | $5\times10^{-7}$ mol | 65 |
| H | 0.35 μm | $1.5\times10^{-7}$ mol | 75 |

To each of these emulsions was added the following additives in the amounts set forth below (per mol of silver halide).

| (Formulation of emulsion coating solution) | | |
|---|---|---|
| a. | Spectral sensitizing dye (2) | $1.0\times10^{-4}$ mol |
| b. | Supersensitizing dye (3) | $0.7\times10^{-3}$ mol |
| c. | Preservability improver (4) | $1\times10^{-3}$ mol |
| d. | Polyacrylamide (molecular amount: 40,000) | 10 g |
| e. | Dextran | 10 g |
| f. | Trimethylolpropane | 1.6 g |
| g. | Sodium polystyrenesulfonate | 1.2 g |
| h. | Latex of poly(ethyl acrylate/methacrylic acid) | 12 g |
| i. | N,N′-ethylenebis-(vinylsulfoneacetamide) | 3.0 g |
| j. | 1-Phenyl-5-mercapto-tetrazole | 50 mg |

Spectral sensitizing dye (2)

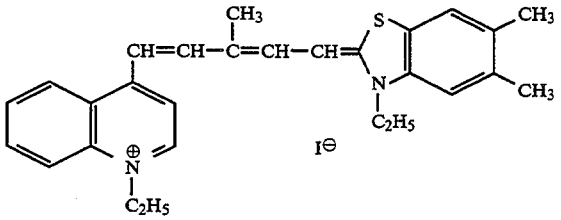

Supersensitizer (3)

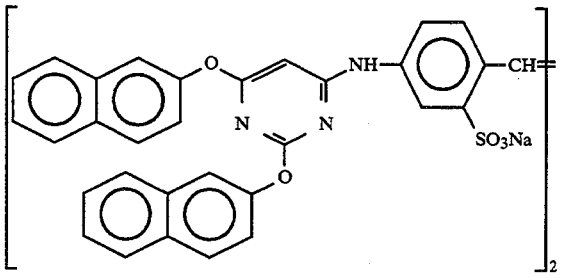

Preservability improver (4)

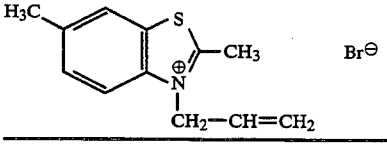

3. Preparation of Coating Solution for Surface Protective Layer for Emulsion Layer A vessel was heated to a temperature of 40° C. Additives having the following formulations were then added to the system to prepare a coating solution.

| (Formulation of coating solution for surface protective layer for emulsion layer) | | |
|---|---|---|
| a. | Gelatin | 100 g |
| b. | Polyacrylamide (molecular weight: 40,000) | 12 g |
| c. | Sodium polystyrenesulfonate (molecular weight: 600,000) | 0.6 g |
| d. | N,N'-ethylenebis-(vinylsulfonacetamide) | 2.2 g |
| e. | Finely divided polymethyl methacrylate grains (average grain size: 2.0 μm) | 2.7 g |
| f. | Sodium t-octylphenoxyethoxy-ethanesulfonate | 1.8 g |
| g. | $C_{16}H_{33}O—(CH_2CH_2O)_{10}—H$ | 4.0 g |
| h. | Sodium polyacrylate | 6.0 g |
| i. | $C_8F_{17}SO_3K$ | 70 mg |

-continued

| (Formulation of coating solution for surface protective layer for emulsion layer) | | |
|---|---|---|
| j. | $C_8F_{17}SO_2N(C_3H_7)(CH_2CH_2O)_4(CH_2)_4—SO_3Na$ | 70 mg |
| k. | NaOH(1N) | 6 ml |
| l. | Methanol | 90 ml |
| m. | 1-Phenyl-5-mercapto-tetrazole | 80 mg |
| n. | Compound (5) | 0.06 g |

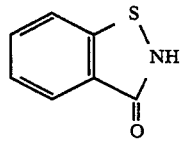

4. Preparation of Coating Solution for Back Layer

A vessel was heated to a temperature of 40° C. Additives having the following formulations were then added to the system to prepare a coating solution for a back layer.

| (Formulation of coating solution for back layer) | | |
|---|---|---|
| a. | Gelatin | 100 g |
| b. | Dye (6) | 4.2 g |
| c. | Sodium polystyrenesulfonate | 1.2 g |
| d. | Latex of poly(ethyl acrylate/methacrylaic acid) | 5 g |
| e. | N,N'-ethylenebis-(vinylsulfonacetamide) | 4.8 g |
| f. | Compound (5) | 0.06 g |
| g. | Dye (7) | 0.3 g |
| h. | Dye (8) | 0.05 g |

Dye (6)

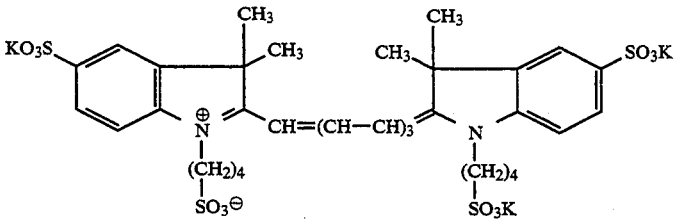

Dye (7)

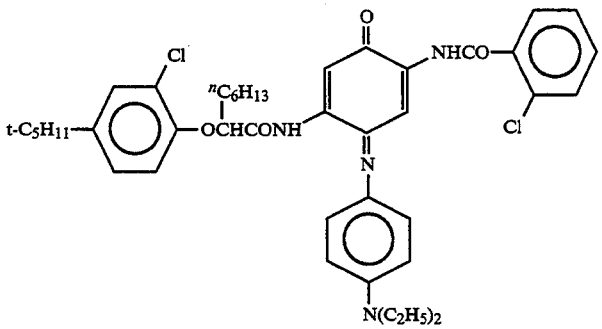

Dye (8)

-continued (Formulation of coating solution for back layer)

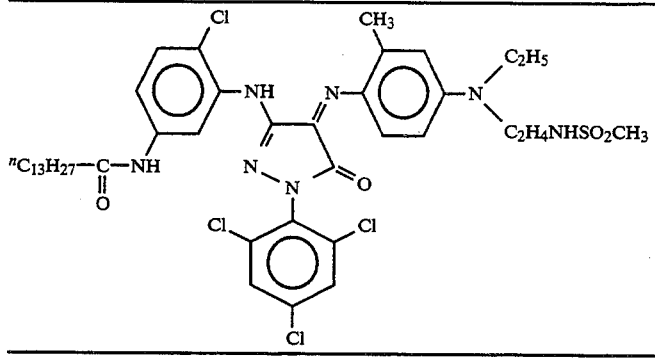

5. Preparation of Coating Solution for Surface Protective Layer on Back Layer

A vessel was heated to a temperature of 40° C. Additives having the following formulations were then added to the system to prepare a coating solution.

| | | |
|---|---|---|
| a. | Gelatin | 100 g |
| b. | Sodium polystyrenesulfonate | 0.5 g |
| c. | N,N'-ethylenebis-(vinylsulfonacetamide) | 1.9 g |
| d. | Finely divided polymethylmethacrylate grains (average grain size: 4.0 μm) | 4 g |
| e. | Sodium t-octylphenoxyethoxy-ethanesulfonate | 2.0 g |
| f. | NaOH (1N) | 6 ml |
| g. | Sodium polyacrylate | 2.4 g |
| h. | $C_6H_{33}O—(CH_2CH_2O)_{10}—H$ | 4.0 g |
| i. | $C_8F_{17}SO_3K$ | 70 mg |
| j. | $C_8F_{17}SO_2(C_3H_7)(CH_2CH_2O)_4(CH_2)_4—SO_3Na$ | 70 mg |
| k. | Methanol | 150 ml |
| l. | Compound (5) | 0.06 g |

6. Preparation of Photographic Material

The aforementioned back layer coating solution was coated on one side of a polyethylene terephthalate support along with the coating solution for surface protective layer for back layer in such an amount that the total coated amount of gelatin reached 3.0 g/m$^2$.

Subsequently, the aforementioned emulsion coating solutions and surface protective layer coating solution were coated on the opposite side of the support from the backing in an amount such that the total coated amount of silver and the coated amount of gelatin in the surface protective layer reached 2.6 g/m$^2$ and 1.0 g/m$^2$, respectively. The coated amount of silver in an upper emulsion layer was equal to that of the lower emulsion layer to prepare coat specimens but with a lower iridium content, as set forth in Table 2 (Specimens 1-1 to 1-10). The sensitivity of each individual emulsion layer was measured by the sensitometry method as mentioned below. The results are set forth in Table 1.

7. Sensitometry Method

The photographic material specimens 1-1 to 1-10 thus prepared were then subjected to sensitometry in the manner as mentioned below to determine sensitivity and γ. After coating, the photographic material specimens 1-1 to 1-10 were allowed to stand at a temperature of 25° C. and a relative humidity of 60% for 7 days. These specimens were then subjected to scanning exposure with a semiconductor laser emitting light in the wavelength of 780 nm at room temperature for about $10^{-7}$ seconds. These specimens were then developed with a developer RDIII and a fixing solution Fuji-F available from Fuji Photo Film Co., Ltd. at a developing temperature of 35° C. for 90 seconds (dry-to-dry time) by means of a Type FPM5000 automatic processor (available from Fuji Photo Film Co., Ltd.) to determine sensitivity and the maximum value of γ. The conveying speed of the film was 2,100 mm/min. The automatic processor was modified such that the conveying speed can be varied. These specimens were then subjected to development for 30 seconds (dry-to-dry time) to determine the change in γ between 90" and 30" ("=seconds) (Δγ in Table 2).

The sensitivity was relatively represented by the reciprocal of the exposure at an optical density of a developed density at unexposed portion +1.0 on the characteristic curve of optical density versus logarithm of exposure in accordance with the customary method.

The value of γ is defined as the gradient of the tangent (optical density/logarithm of exposure) of the same characteristic curve. In Table 2, γmax represents the maximum value of γ, and Δγmax (90"−30") represents the difference in the maximum value of γ between the processing for 90" and 30" ("=seconds). The smaller this difference, the more rapid is the progress of development. Table 2 shows that Specimens 1-6 to 1-10, prepared according to the present invention, exhibit a small change in the maximum value of γ between 90" and 30" so far as the maximum value of γ is not more than 3.2, showing a low γ value and a rapid progress of development.

8. Test Method for Unevennes Due to Scanning Exposure

The photographic material specimens thus prepared were subjected to uniform scanning exposure by means of a 780 nm semiconductor laser (FCR7000 Laser Image Printer; Type CR-LP414) at room temperature in such a manner that the resulting optical density reached 1.0. The specimens were then developed with a developer RD-III and a fixing solution Fuji-F available from Fuji Photo Film Co., Ltd. by means of a type FPM5000 automatic processor available from Fuji Photo Film Co., Ltd. at a developing temperature of 35° C. for 90 seconds (dry-to-dry time). The specimens were then visually evaluated for density uniformity and unevenness. In Table 2, A represents the condition in which no unevenness is observed, B represents the condition in which a slight unevenness is observed but with no practical problem, and C represents the condition in which unevenness is obviously observed.

It can be seen in Table 2 that as γmax exceeds 3.2, the unevenness is worsened. The unevenness due to scanning exposure as used herein is a phenomenon in which the overlapping of adjacent lines due to insufficient accuracy of film conveying causes a density unevenness.

TABLE 2

| Photographic material No. | | Upper layer emulsion | Iridium content (per mol of Ag) | Lower layer emulsion | Iridium content (per mol of Ag) | $S_{1.0}$ (90") | γmax (90") | Δγmax (90") − (30") | Scanning exposure unevenness |
|---|---|---|---|---|---|---|---|---|---|
| 1-1 | Comparison | A | $1 \times 10^{-7}$ | B | $5 \times 10^{-7}$ | 100 | 2.8 | +0.2 | A |
| 1-2 | " | A | " | D | $1.5 \times 10^{-7}$ | 100 | 3.3 | +0.4 | B |
| 1-3 | " | A | " | F | $5 \times 10^{-8}$ | 110 | 3.5 | +0.5 | C |
| 1-4 | " | B | " | C | $1.5 \times 10^{-7}$ | 120 | 3.0 | +0.2 | A |
| 1-5 | " | C | $3 \times 10^{-8}$ | D | " | 125 | 3.2 | +0.3 | A |
| 1-6 | Invention | D | $3 \times 10^{-8}$ | A | $5 \times 10^{-7}$ | 95 | 3.1 | 0.10 | A |
| 1-7 | " | C | " | B | " | 125 | 2.8 | 0.10 | A |
| 1-8 | " | E | $1 \times 10^{-8}$ | A | " | 165 | 3.2 | 0.14 | A |
| 1-9 | " | E | " | B | " | 160 | 2.7 | 0.08 | A |
| 1-10 | " | E | " | D | $1.5 \times 10^{-7}$ | 160 | 2.8 | 0.10 | A |

EXAMPLE 2

Photographic material specimens 2-1 to 2-8 were prepared by coating the emulsions as prepared in Example 1 and combined as set forth in Table 3 on a polyethylene terepthalate support in the same manner as in Example 1. These photographic material specimens were then subjected to sensitometry in the same manner as in Example 1 to determine sensitivity, maximum γ value and gloss on the maximum density portion. In Table 3, $S_{1.0}(a)/S_{1.0}(b)$ represents the ratio of the sensitivity of the upper emulsion layer to that of the lower emulsion layer at an optical density of density at unexposed portion +1.0 (reciprocal of exposure), and γmax <a>and γmax <b> represent the maximum γ value of the upper emulsion layer and the lower emulsion layer, respectively.

The surface gloss at the maximum density portion is represented by the 20° reflectivity of a light which is incident at a right angle. The measurement was effected by means of a MODEL-1001DP digital angle-variable glossmeter available from Nihon Denshoku Kogyo K.K.

It can be seen from Table 3 that the photographic material specimens 2-6 to 2-8, prepared according to the present invention, maintain a low γ value to exhibit a properly low gloss.

TABLE 3

| Photographic material No. | | <a> Upper layer emulsion | <b> Lower layer emulsion | γmax <a> (90") | γmax <b> (90") | $S_{1.0}(a)/S_{1.0}(b)$ (90") | γmax (90") | Surface gloss relfectivity (at 20°) | Scanning gloss unevenness |
|---|---|---|---|---|---|---|---|---|---|
| 2-1 | Comparison | A | C | 3.7 | 3.4 | 0.80 | 3.4 | 15 | B |
| 2-2 | " | B | C | 4.1 | 3.4 | 0.32 | 3.0 | 45 | A |
| 2-3 | " | B | D | 4.1 | 3.8 | 0.80 | 3.7 | 55 | C |
| 2-4 | " | 1:1 mixture of A and D | | — | — | — | 3.3 | 35 | B |
| 2-5 | " | 1:1 mixture of B and C | | — | — | — | 2.9 | 35 | A |
| 2-6 | Invention | C | B | 3.4 | 4.2 | 0.32 | 2.8 | 30 | A |
| 2-7 | " | C | G | 3.4 | 3.9 | 1.92 | 3.2 | 25 | A |
| 2-8 | " | E | H | 3.2 | 3.6 | 2.13 | 3.1 | 25 | A |

EXAMPLE 3

The photographic material specimens 2-1 to 2-8 as used in Example 2 was subjected to sensitometry in the manner as mentioned below to measure sensitivity, maximum γ value and gloss.

After coating, the coat specimens were allowed to stand at a temperature of 25° C. and a humidity of 60% for 7 days. These specimens were then subjected to scanning exposure with a 780 nm semiconductor laser (FCR7000 Laser Image Printer: Type CR-LP414 available from Fuji Photo Film Co., Ltd.) at room temperature. These specimens were then developed for dry-to-dry 67" by means of FCR automatic processor available from Fuji Photo Film Co., Ltd.

The conveying speed was 1,400 mm/min.

The automatic processor was remodelled such that the conveying speed was varied to enable dry-to-dry 30" processing. Thus, photographic properties and gloss were determined.

The results are set forth in Table 4.

The developer and fixing solution used had the following comositions:

| <Composition of developer> | |
|---|---|
| KOH | 57.5 g |
| $Na_2SO_3$ | 87.5 g |
| $K_2SO_3$ | 110 g |
| Diethylenetriaminepentaacetic acid | 5 g |
| Boric acid | 25 g |
| $K_2CO_3$ | 32.5 g |
| Hydroquinone | 87.5 g |
| Diethylene glycol | 125 g |
| 4-Hydroxymethyl-4-methyl-1-phenyl-3-pyrazolidone | 10 g |
| 5-Methylbenzotriazole | 0.15 g |
| 2,3,5,6,7,8-Hexahydro-2-thioxo-4(1H)quinazolinone | 0.25 g |
| Sodium 2-mercaptobenzimidazole-5-sulfonate | 0.35 g |
| KBr | 7.5 g |
| 1-Phenyl-5-mercapto-tetrazole | 0.15 g |
| Water to make | 1 l |

| <Composition of fixing solution> | |
|---|---|
| Ammonium thiosulfate | 145 g |
| Disodium ethylenediaminetetraacetate dihydrate | 30 mg |
| $Na_2S_2O_3.5H_2O$ | 15 g |
| Sodium metabisulfite | 13.3 g |
| NaOH | 12.6 g |
| 90 wt. % acetic acid | 30 g |
| KI | 0.5 g |

-continued

| | |
|---|---|
| Water to make | 1 l |

TABLE 4

| Photographic material No. | | <a> Upper layer emulsion | <b> Lower layer emulsion | $S_{1.0}(a)/S_{1.0}(b)$ (90") | γmax (90") | Gloss (reflectivity at 20°) (%) |
|---|---|---|---|---|---|---|
| 2-1 | Comparison | A | C | 0.76 | 3.4 | 3 |
| 2-2 | " | B | C | 0.35 | 3.0 | 24 |
| 2-3 | " | B | D | 0.78 | 3.7 | 36 |
| 2-4 | " | 1:1 mixture of A and D | | — | 3.3 | 12 |
| 2-5 | " | 1:1 mixture of B and C | | — | 2.9 | 12 |
| 2-6 | Invention | C | B | 3.02 | 2.8 | 6 |
| 2-7 | " | C | G | 2.04 | 3.2 | 5 |
| 2-8 | " | E | H | 2.14 | 3.1 | 5 |

EXAMPLE 4

1. Preparation of Silver Halide Emulsions I to N 32 g of gelatin was dissolved in 760 ml of water in a vessel which was then heated to a temperature as set forth in Table 5. 5 g of sodium chloride, 0.3 g of potassium bromide, and 0.35 g of Compound (A) as used in Example 1 were added to the system. 490 ml of an aqueous solution containing 160 g of silver nitrate and 454 ml of an aqueous solution containing potassium hexachloroiridiumate (III) in an amount as set forth in Table 5 (per mol of produced silver halide), 11 g of sodium chloride and 27.1 g of potassium bromide were then added to the system by a double jet process to prepare a monodisperse emulsion of cubic silver bromochloride grains having an average grain size as set forth in Table 5 (fluctuation coefficient in grain size distribution: 10%).

The emulsion was then desalted. 61.6 g of gelatin was then added to the emulsion. The pH value of the emulsion was thus adjusted to 6.5 at a temperature of 40° C. The pAg value of the emulsion was then adjusted with calcium chloride to 8.5. 2.3 g of Phenoxyethanol was added to the emulsion. The emulsion was then subjected to optimum chemical sensitization with 2 mg of sodium thiosulfate and 4.2 mg of chloroauric acid at an elevated temperature of 65° C. 0.46 g of 4-Hydroxy-6-methyl-1,3,3a,7-tetrazaindene was added to the emulsion. The emulsion was then rapidly cooled and solidified to prepare Emulsions I to N.

TABLE 5

| Photographic material No. | Emulsion | Grain forming temperature (°C.) | Iridium compound content (mol/mol of produced silver halide) | Grain size* (μm) | Photographic density (FPM 5000 90" processing) |
|---|---|---|---|---|---|
| 3-1 | I | 49 | $1 \times 10^{-8}$ | 0.3 | 100 |
| 3-2 | J | 49 | $1 \times 10^{-7}$ | " | 64 |
| 3-3 | K | 49 | $3.5 \times 10^{-7}$ | " | 50 |
| 3-4 | L | 61 | $1 \times 10^{-8}$ | 0.41 | 174 |
| 3-5 | M | 61 | $1 \times 10^{-7}$ | " | 112 |
| 3-6 | N | 61 | $3.5 \times 10^{-7}$ | " | 87 |

*diameter as calculated in terms of projected area

2. Preparation of Emulsion Coating Solution

To each of these emulsions was added the following chemicals in the amount set forth below (per mol of silver halide) to prepare an emulsion coating solution.

| | | |
|---|---|---|
| a. | Spectral sensitizing dye (A) | 121 mg |
| b. | Spectral sensitizing dye (B) | 101.4 mg |
| c. | Polyacrylamide (molecular amount: 40,000) | 8.93 g |
| d. | Trimethylol propane | 1.2 g |
| e. | Sodium polystyrenesulfonate (average molecular weight: 600,000) | 0.47 g |
| f. | Latex of poly(ethyl acrylate/metacrylic acid) | 27.5 g |
| g. | 1,2-Bis(vinylsulfonylacetamide)ethane | 1.9 g |

Spectral sensitizing dye (A)

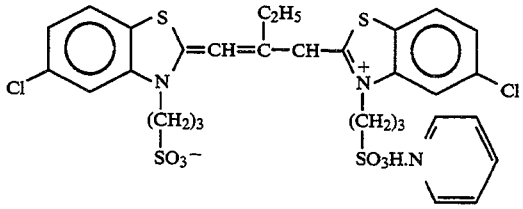

Spectral sensitizing dye (B)

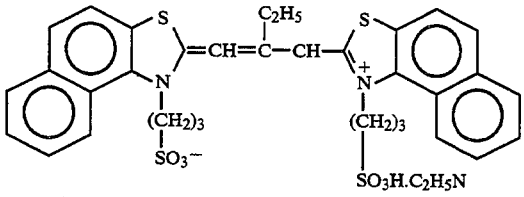

| | | |
|---|---|---|
| h. | Potassium dihydroxybenzensulfoante | 4.1 g |
| i. | 20% Solution of colloidal silica (Snowtex C available from Nissan Chemical Industries, Ltd.) | 33 cc |
| j. | Mercapto compound (A) | 38 mg |

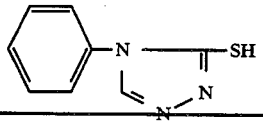

| | | |
|---|---|---|
| k. | Dye (A) | 1 g |

-continued

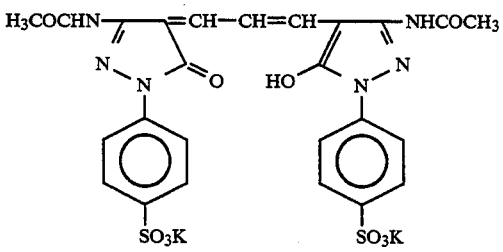

3. Preparation of Coating Solution for Surface Protective Layer for Emulsion Layer A vessel was heated to a temperature of 40° C. The following chemicals were added to the system to prepare a coating solution.

| | | |
|---|---|---|
| a. | Gelatin | 75 g |
| b. | Polyacrylamide (molecular amount: 40,000) | 12.3 g |
| c. | Sodium polystyrenesulfonate (molecular amount: 600,000) | 0.6 g |
| d. | Finely divided polymethyl methacrylate (average grain size: 2.5 μm) | 2.7 g |
| e. | Sodium polyacrylate | 3.7 g |
| f. | Sodium t-octylphenoxyethoxyethane-sulfonate | 1.5 g |
| g. | $C_{16}H_{33}O—(CH_2CH_2O)_{10}—H$ | 3.3 g |
| h. | $C_8F_{17}SO_3K$ | 84 mg |
| i. | $C_8F_{17}SO_2N(C_3H_7)(CH_2CH_2O)_4(CH_2)_4—SO_3Na$ | 84 mg |
| j. | NaOH | 0.2 g |
| k. | Methanol | 78 cc |
| l. | 1,2-Bis(vinylsulfonylacetamide)ethane Amount such that the ratio of the thickness of the film when the emulsion side of the photographic material is dipped in 21° C. distilled water for 3 minutes to the dry thickness reaches 1.6 | |
| m. | Compound (5) as used in Example 1 | 52 mg |
| n. | Mercapto compound (2) | 265 mg |

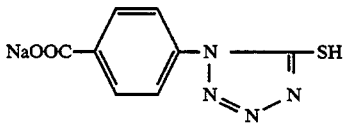

4. Preparation of Back Layer Coating Solution

A vessel was heated to a temperature of 40° C. The following chemicals were added to the system to prepare a back layer coating solution.

| | | |
|---|---|---|
| a. | Gelatin | 100 g |
| b. | Dye (B) | 2.39 g |

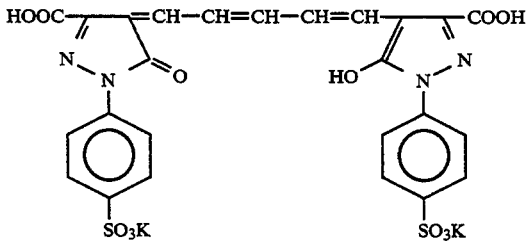

| | | |
|---|---|---|
| c. | Sodium polystyrenesulfonate | 1.1 g |
| d. | Phosphoric acid | 0.55 g |
| e. | Latex of poly(ethylacrylate/methacrylic acid) | 2.9 g |
| f. | Compound (5) as used in Example 1 | 46 mg |
| g. | Oil dispersion of Dye (7) of Example 1 as described in JP-A-61-285445 | 246 mg in terms of dye |
| h. | Oligomer surface active agent | 46 mg |

-continued

| | | |
|---|---|---|
| | dispersion of Dye (8) of Example 1 as described in JP-A-62-275639 | in terms of dye |

5. Preparation of Coating Solution for Surface Protective Layer for Back Layer (Back Surface Protective Layer)

A vessel was heated to a temperature of 40° C. The following chemicals were added to the system to prepare a coating solution.

| | | |
|---|---|---|
| a. | Gelatin | 100 g |
| b. | Sodium polystyrenesulfonate | 0.3 g |
| c. | Finely divided polymethylmethacrylate grains (average grain size: 3.5 μm) | 4.3 g |
| d. | Sodium t-octylphenoxyethoxyethanesulfonate | 1.8 g |
| e. | Sodium polyacrylate | 1.7 g |
| f. | $C_{16}H_{33}O—(CH_2CH_2O)_{10}—H$ | 3.6 g |
| g. | $C_8F_{17}SO_3K$ | 268 mg |
| h. | $C_8F_{17}SO_2N(C_3H_7)(CH_2CH_2O)_4(CH_2)_4—SO_3Na$ | 45 mg |
| i. | NaOH | 0.3 g |
| j. | Methanol | 131 ml |
| k. | 1,2-Bis(vinylsulfonylacetamide)ethane Amount such that the ratio of the thickness of the film when the back side of the photographic material is dipped in 21° C. distilled water for 3 minutes to dry thickness reaches 1.8 | |
| l. | Compound (5) as used in Example 1 | 45 mg |

6. Preparation of Photographic Material

The aforementioned back layer coating solution was coated on one side of a blue-colored polyethylene terephthalate support along with the coating solution for back surface protective layer in such a manner that the coated amount of gelatin in the back layer and the coated amount of gelatin in the back surface protective layer reached 2.69 g/m$^2$ and 1.13 g/m$^2$, respectively. Subsequently, the aforementioned emulsion coating solution and surface protective layer coating solution were coated on the opposite side of the support in such an amount that the coated amount of silver and gelatin in the emulsion coating solution and the coated amount of gelatin in the surface protective layer reached 2.6 g/m$^2$, 2.0 g/m$^2$ and 0.9 g/m$^2$, respectively, to prepare photographic material specimens 3-1 to 3-6 having a singly-coated emulsion layer. The various emulsion coating solutions were each coated in two layers, i.e., upper layer and lower layer in such an amount that the coated amount of silver in each layer reached 1.3 g/m$^2$ to prepare photographic material specimens 3-7 to 3-14.

7. Sensitometry Method

The photographic material specimens thus prepared were subjected to sensitometry in the following manner to measure photographic sensitivity.

The photographic material specimens were allowed to stand at a temperature of 25° C. and a relative humidity of 60% for 7 days after coating, and then exposed to light from 633 nm He-Ne laser (AC-1, available from Fuji Photo Film Co., Ltd.).

The development of these photographic material specimens 3-1 to 3-14 was conducted by means of FPM5000 automatic processor as used in Example 1 (available from Fuji Photo Film Co., Ltd.) at a developing temperature of 35° C. for 90 seconds (dry-to-dry time) at a conveying speed of 2,100 mm/min.

The photographic material specimens 3-1 to 3-6 having a singly-coated emulsion layer were measured for photographic sensitivity. The photographic material specimens 3-7 to 3-14 having multi-coated emulsion layers were measured for photographic sensitivity and maximum γ value. The results are set forth in Tables 5 and 6.

The photographic sensitivity was represented by the reciprocal of the exposure giving an optical density of 1.0, relative to that of the photographic material specimen 3-1 as 100.

The photographic material specimens 3-7 to 3-14 were developed for 30 seconds (dry-to-dry time) in the following manner. These photographic material specimens were then evaluated for photographic sensitivity, maximum γ value, surface gloss (reflectivity) as determined in accordance with Example 2, and unevenness due to laser scanning exposure as determined in accordance with Example 1. The results are set forth in Table 6.

TABLE 6

| Photographic material No. | Upper layer emulsion | Lower layer emulsion | Photographic sensitivity (FPM 5000 90" processing) | Maximum γ value (FPM 5000 90" processing) | Photographic sensitivity (remodelled CEPROS-M 30" processing) | Surface gloss reflectivity (%) | Unevenness in surface gloss due to exposure |
|---|---|---|---|---|---|---|---|
| 3-7 (Comparison) | I | J | 90 | 3.3 | 80 | 57 | B~A |
| 3-8 (Invention) | I | K | 85 | 3.1 | 85 | 57 | A |
| 3-9 (Comparison) | L | M | 157 | 3.3 | 140 | 16 | B~C |
| 3-10 (Invention) | L | N | 148 | 3.1 | 148 | 16 | A |
| 2-11 (Comparison) | L | I | 153 | 3.2 | 130 | 32 | B |
| 3-12 (Invention) | L | K | 100 | 2.7 | 100 | 32 | A |
| 3-13 (Comparison) | M | I | 100 | 3.7 | 89 | 32 | C |
| 3-14 (Invention) | L | J | 100 | 2.8 | 98 | 32 | A |

The automatic processor used in this test was a remodelled version of Type CEPROS-M automatic processor available from Fuji Photo Film Co., Ltd. The processing procedure was set forth in Table 7. The average daily processed amount of photographic material was about 200 sheets of quater-size photographic material (10 inch×12 inch).

TABLE 7

| Processing step | Processing tank capacity | Processing temperature | Processing path length | Processing time |
|---|---|---|---|---|
| Development | 15 l | 35° C. | 613 mm | 9.1 sec. |
| (liquid surface area/processing tank capacity = 25 $cm^2/l$) | | | | |
| Fixing | 15 l | 32° C. | 475 mm | 7.0 sec. |
| | 13 l | 17° C. | 263 mm | 3.9 sec. |
| | | (flowing water) | | |
| Squeeze | | | 223 mm | 3.3 sec. |
| Drying | | 58° C. | 454 mm | 6.7 sec. |
| | | (hot air) | | |
| | | (two pairs of 100° C. heat rollers) | | |
| Total | | | 2,028 mm | 30.0 sec. |

(Heat roller is further described in Japanese Patent Application No. 2-280227)

The various processing solutions and their replenishers used were as follows:

Development

| Preparation of concentrated solution | |
|---|---|
| <Developer> | |
| Part A | |
| Potassium hydroxide | 270 g |
| Potassium sulfite | 1,125 g |
| Sodium carbonate | 450 g |
| Boric acid | 75 g |
| Diethylene glycol | 150 g |
| Diethylenetriaminepentaacetic acid | 30 g |
| 1-(N,N-diethylamino)ethyl-5-mercaptotetrazole | 1.5 g |
| Hydroquinone | 405 g |
| 4-Hydroxymethyl-4-methyl-1-phenyl-3-pyrazolidone | 30 g |
| Water to make | 4,500 ml |
| Part B | |
| Tetraethylene glycol | 750 g |
| 3,3'-Dithiobishydrocinnamic acid | 3 g |
| Glacial acetic acid | 75 g |
| 5-Nitroindazole | 4.5 g |
| 1-Phenyl-3-pyrazolidone | 67.5 g |
| Water to make | 1,000 ml |
| Part C | |
| Glutaraldehyde (50 wt/wt %) | 150 g |
| Potassium bromide | 15 g |
| Potassium metabisulfite | 120 g |
| Water to make | 750 ml |
| <Fixing solution> | |
| Ammonium thiosulfate (70 wt/vol %) | 3,000 ml |
| Disodium ethylenediaminetetraacetate dihydrate | 0.45 g |
| Sodium sulfite | 225 g |
| Boric acid | 60 g |
| 1-(N,N-dimethylamino)-ethyl-5-mercaptotetrazole | 15 g |
| Tartaric acid | 48 g |
| Glacial acetic acid | 675 g |
| Sodium hydroxide | 225 g |
| 36 N sulfuric acid | 58.5 g |
| Aluminum sulfate | 150 g |
| Water to make | 6,000 ml |
| pH | 4.68 |

Preparation of Processing Solution

The aforementioned concentrated solutions were packed into the respective vessel for each part. These vessels for Parts A, B and C were connected to each other.

The aforementioned concentrated solution of fixing solution was packed into the same kind of vessel.

300 ml of an aqueous solution containing 54 g of acetic acid and 55.5 g of potassium bromide was added in the developing tank as a starter.

These processing agent-containing vessels were inverted and pushed against a piercing blade in a processing solution stock tank provided on the side of the automatic processor so that a sealing diaphragm on the cap was broken to allow the processing agent to be packed into the stock tank.

These processing agents were thus packed into the developing tank and fixing tank in the automatic processor in the proportion set forth below by operating a pump installed in the automatic processor.

Every time photographic materials were processed by a constant amount as calculated in terms of 8 sheets of quater-size photographic material were processed, the processing agents and water were mixed in this proportion and then packed into the processing tank in the automatic processor.

| | |
|---|---|
| Developer | |
| Part A | 60 ml |
| Part B | 13.4 ml |
| Part C | 10 ml |
| Water | 116.6 ml |
| pH | 10.50 |
| Fixing solution | |
| Concentrated solution | 80 ml |
| Water | 120 ml |
| pH | 4.62 |

The washing tank was filled with tap water.

Table 6 shows that the photographic materials of the present invention exhibit less sensitivity difference between 30 second processing and 90 second processing and thus have no problem of unevenness due to scanning exposure.

It was also shown that the photographic material specimens comprising grains having a larger size in the upper emulsion layer than in the lower emulsion layer are excellent in surface gloss.

These results show that the present invention is effective.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a hydrophilic colloidal layer structure including at least two silver halide emulsion layers including a lower silver halide emulsion layer comprising silver halide grains and an upper silver halide emulsion layer comprising silver halide grains, both of said emulsion layers being provided on at least one side of a transparent support, and at least said lower silver halide emulsion layer contains an iridium compound, wherein the average amount of iridium compound per unit mol of silver in said lower silver halide emulsion layer located nearer to said support is greater than the iridium content of said upper silver halide emulsion layer located further from said support, and the maximum value of $\gamma$ on the characteristic curve of optical density versus exposure (logarithm) of said photographic material is not more than 3.2 when said silver halide photographic material is exposed to laser light having a wavelength falling within the range of 600 to 850 nm for forming an image.

2. The silver halide photographic material according to claim 1, wherein said lower silver halide emulsion layer and said upper silver halide emulsion layer have different photographic sensitivities, and the ratio of photographic sensitivity of the silver halide emulsion layer having the highest sensitivity to that of the silver halide emulsion layer having the lowest sensitivity is 1.5 or more as calculated in terms of the reciprocal of the exposure at an optical density of fog +1.0 when exposed to laser light having a wavelength falling within the range of 600 to 850 nm for forming an image.

3. The silver halide photographic material according to claim 2, wherein the ratio of photographic sensitivity of the silver halide emulsion layer having the highest sensitivity to that of the silver halide emulsion layer having the lowest sensitivity is 2 or more.

4. The silver halide photographic material according to claim 1, wherein said lower silver halide emulsion layer and said upper silver halide emulsion layer each comprises silver bromochloride having a silver chloride content of 5 to 50 mol %.

5. The silver halide photographic material according to claim 1, wherein the amount of iridium compound in said upper silver halide emulsion layer is up to 90% of the amount of said iridium compound in said lower silver halide emulsion layer.

6. The silver halide photographic material according to claim 5, wherein the amount of iridium compound in said upper silver halide emulsion layer is 5 to 80% of the amount of said iridium compound in said lower silver halide emulsion layer.

7. The silver halide photographic material according to claim 1, wherein the iridium compound is selected from a hexachloroiridium (III) complex salt, a hexachloroiridium (IV) complex salt, a hexamineiridium (III) complex salt, a hexamineiridium (IV) complex salt, a trioxalateiridium (III) complex salt and a trioxalateiridium (IV) complex salt.

8. The silver halide photographic material according to claim 1, wherein the iridium compound is added during formation of at least the silver halide grains of the lower silver halide emulsion layer.

9. The silver halide photographic material according to claim 1, wherein said lower silver halide emulsion layer contains at least $1\times10^{-8}$ mol of said iridium compound per mol of silver halide.

10. The silver halide photographic material according to claim 9, wherein said lower silver halide emulsion layer contains $1\times10^{-8}$ to $1\times10^{-5}$ mol of said iridium compound per mol of silver halide.

11. The silver halide photographic material according to claim 10, wherein said lower silver halide emulsion layer contains $5\times10^{-8}$ to $5\times10^{-6}$ mol of said iridium compound per mol of silver halide.

* * * * *